US006617099B2

(12) United States Patent
Taniguchi et al.

(10) Patent No.: US 6,617,099 B2
(45) Date of Patent: Sep. 9, 2003

(54) SILVER HALIDE COLOR PHOTOGRAPHIC LIGHTSENSITIVE MATERIAL AND PROCESSING METHOD THEREOF

(75) Inventors: Masahiko Taniguchi, Minami-Ashigara (JP); Naoto Matsuda, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/061,212

(22) Filed: Feb. 4, 2002

(65) Prior Publication Data

US 2002/0168595 A1 Nov. 14, 2002

(30) Foreign Application Priority Data

Feb. 2, 2001 (JP) ..... 2001-027472

(51) Int. Cl.[7] ..... G03C 1/295
(52) U.S. Cl. ..... 430/503
(58) Field of Search ..... 430/503

(56) References Cited

U.S. PATENT DOCUMENTS 4,770,990 A 9/1988 Nakamura et al.
H830 H 10/1990 Deguchi et al.

FOREIGN PATENT DOCUMENTS

EP 0 220 746 * 5/1987
EP 0 530 681 * 3/1993

* cited by examiner

*Primary Examiner*—Hoa Van Le
(74) *Attorney, Agent, or Firm*—Sughrue Mion, PLLC

(57) ABSTRACT

A silver halide color photographic light-sensitive material containing at least one kind of a compound represented by formula (I):

(I)

Where each of $R^1$, $R^3$ and $R^4$ independently represents a hydrogen atom or a substituent, $R^2$ represents a substituent, a represents an integer of 0 to 4, wherein if a is not less than 2, a plurality of $R^2$'s may be the same or different, and if a is 1, $R^2$ is selected from substituents having a σp value of 0 to 0.53, and if a is 2 to 4, $R^2$ is selected from substituents having a σp value of 0 to 0.53 in total, Time represents a group which releases —S—$R^5$ after being eliminated as $(Time)_t$-S—$R^5$, t is 0 or 1, and $R^5$ represents an organic group which is bonded with S by its $sp^3$ carbon.

8 Claims, No Drawings

SILVER HALIDE COLOR PHOTOGRAPHIC LIGHTSENSITIVE MATERIAL AND PROCESSING METHOD THEREOF

CROSS-REFERENCE TO RELATED APPLICATIONS

This application is based upon and claims the benefit of priority from the prior Japanese Patent Application No. 2001-027472, filed Feb. 2, 2001, the entire contents of which are incorporated herein by reference.

BACKGROUND OF THE INVENTION

1. Field of the Invention

The present invention relates to a silver halide color photographic lightsensitive material having superior desilverizing property and a color image forming method thereof.

2. Description of the Related Art

A silver halide color reversal photographic lightsensitive material forms an image by the first development being black and white development and a successive color development, and then desilverized by carrying out bleach-fixing, but there is a case that desilverization is bad (a phenomenon in which a metal silver remains in a film) depending on the composition of the bleach liquid or the fluctuation of the liquid composition of pre-bleach which is set for acceleration of the bleach. In a color reversal photographic lightsensitive material, since almost all of silver halide which was coated is developed at the first development to be a metal silver in the white portion of a color image, it is apt to cause the inferiority of desilverization at the white portion, and since it is accompanied with the contamination of the white portion, commodity value is greatly damaged.

A pre-bleach processing is included for acceleration of bleach in an E-6 process which is a standard processing of color reversal film, and thioglycerol is added in a pre-bleach processing solution, but there has been a problem that the thioglycerol decreases in the running condition of the processing solution and a metal silver is apt to remain in accordance with it. It is required as the quality of a color reversal film that it does not depend on the compositional fluctuation of the processing solution and does not provoke the inferiority of desilverization.

As a method of reducing the residual of a metal silver after processing in a color reversal film, there is a method of preliminarily adding a desilverization accelerating agent in any of hydrophilic colloid layers in a lightsensitive material. However, since the desilverization accelerating agent having an effect has usually a mercapto group, it has been difficult to adopt it because of imparting bad influences (the deterioration of the preservation of a lightsensitive material, the decrease of sensitivity and the like) to silver halide in a lightsensitive material.

To the contrary, there are some methods of storing a desilverization accelerating agent in a condition of a precursor in a lightsensitive material and discharging it at processing to obtain an effect. For example, a method of using a desilverization accelerating agent discharging hydroquinone is disclosed in Jpn. Pat. Appln. KOKAI Publication No. (hereinafter referred to as JP-A-) 2-93454. Further, the use of a desilverization accelerating agent discharging reduced compound is disclosed in JP-A-1-26852, and further, a method of using a reducing agent in combination with said reduced compound is also disclosed.

However, even if the desilverization accelerating agent is stored in a lightsensitive material in a condition of a precursor, the desilverization accelerating agent is discharged at the first development in the processing step of a color reversal film, therefore there was a problem that the suppression of development which is not preferred occurs. In particular, influence is great, when a sensitizing development processing in which the first development time is elongated is carried out, and it is not yet dissolved within the range which is disclosed in JP-A-1-26852, and improvement has been further required.

BRIEF SUMMARY OF THE INVENTION

It is an object of the present invention to provide a technique of improving a desilverization property without damaging the preservation property and sensitivity of a lightsensitive material in the silver halide color reversal photographic light sensitive material.

The inventors have conducted extensive and intensive studies, and as a result, the object of the present invention was attained by the constitution below.

(1) A silver halide color photographic light-sensitive material comprising at least one blue-sensitive emulsion layer, at least one green-sensitive emulsion layer, and at least one red-sensitive emulsion layer on a support, the material containing at least one kind of a compound represented by formula (I):

(I)

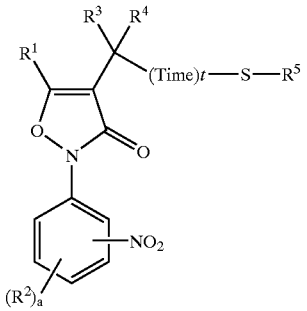

Where each of $R^1$, $R^3$ and $R^4$ independently represents a hydrogen atom or a substituent, $R^2$ represents a substituent, a represents an integer of 0 to 4, wherein if a is not less than 2, a plurality of $R^2$'s may be the same or different, and if a is 1, $R^2$ is selected from substituents having a σp value of 0 to 0.53, and if a is 2 to 4, $R^2$ is selected from substituents having a σp value of 0 to 0.53 in total, Time represents a group which releases —S—$R^5$ after being eliminated as $(Time)_t$-S—$R^5$, t is 0 or 1, and $R^5$ represents an organic group which is bonded with S by its $sp^3$ carbon, wherein a sulfur atom of —S—$R^5$ is bonded with a carbon which is directly substituted with $R^3$ and $R^4$, if t is 0.

(2) The silver halide color photographic lightsensitive material according to item (1) above, wherein at least one $R^2$ in formula (I) represents an acyl group, an alkoxycarbonyl group, an aryloxycarbonyl group, an alkylaminocarbonyl group or an arylaminocarbonyl group.

(3) The silver halide color photographic lightsensitive material according to item (1) above, wherein the compound represented by formula (I) is represented by formula (II):

(II)

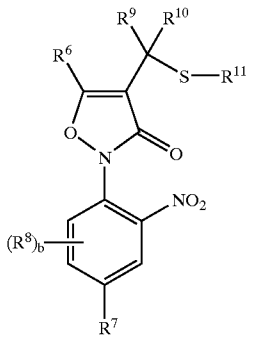

Where each of $R^6$, $R^9$ and $R^{10}$ independently represents a hydrogen atom or a substituent, $R^7$ represents a group selected from an acyl group, an alkoxycarbonyl group, an aryloxycarbonyl group, an alkylaminocarbonyl group, and an arylaminocarbonyl group, $R^8$ represents a substituent, b is an integer of 0 to 3, wherein if b is 2 or 3, a plurality of $R^8$'s may be the same or different, and the total of the σp value of $R^7$ and the σp value of $R^8$ is 0 to 0.53, and $R^{11}$ represents an organic group which is bonded with S by its $sp^3$ carbon.

(4) The silver halide color photographic lightsensitive material according to item (3) above, wherein b in formula (II) is 0.

(5) A color image forming method wherein after image-wise exposure of the silver halide color photographic lightsensitive material according to any one of items (1) to (4) above, it is developed by the first development being black and white development, then subjected to reverse treatment, and color development is carried out in the presence of an aromatic primary amine color developer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention is explained in detail below.

Firstly, the compound represented by general formula (I) of the present invention is explained.

Firstly, $R^1$ is explained. $R^1$ represents a hydrogen atom or a substituent.

As examples when $R^1$ is a substituent, an alkyl group (including a cycloalkyl group and a bicycloalkyl group), an alkenyl group (including a cycloalkenyl group and a bicycloalkenyl group), an alkinyl group, an aryl group, a hetero ring group, a cyano group, a hydroxyl group, a nitro group, a carboxyl group, an alkoxy group, an aryloxy group, a silyloxy group, a hetero ring oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl and arylsulfonylamino group, a mercapto group, an alkylthio group, an arylthio group, a hetero ring thio group, a sulfamoyl group, a sulfo group, an alkyl and arylsulfinyl group, an alkyl and arylsulfonyl group, an acyl group, an aryloxycarbonyl group, an alkoxycarbonyl group, a carbamoyl group, an aryl and hetero ring azo group, an imido group, a phosphino group, a phosphinyl group, a phosphinyloxy group, a phosphinylacyl group, and a silyl group are mentioned.

$R^1$ is preferably a straight chain, branched chain or ring and substituted or unsubstituted alkyl group (preferably, an alkyl group having 1 to 30 carbon atoms, for example, methyl, ethyl, n-propyl, isopropyl, t-butyl, n-octyl, eicosyl, 2-chloroethyl, 2-cyanoethyl, and 2-ethylhexyl), a cycloalkyl group (preferably, a substituted or unsubstituted cycloalkyl group having 3 to 30 carbon atoms, for example, cyclohexyl, cyclopentyl, and 4-n-dodecylcyclohexyl), a bicycloalkyl group (preferably, a substituted or unsubstituted bicycloalkyl group having 5 to 30 carbon atoms, namely, a monovalent group in which a hydrogen atom was eliminated from bicycloalkane having 5 to 30 carbon atoms. For example, it may be bicyclo[1,2,2]heptan-2-yl, bicyclo[2,2,2]octan-3-yl), an alkenyl group [which represents a straight chain, branched chain or ring and substituted or unsubstituted alkenyl group, an alkenyl group (preferably, a substituted or unsubstituted alkenyl group having 2 to 30 carbon atoms, for example, vinyl, aryl, prenyl, geranyl, and oleyl), a cycloalkenyl group (preferably, a substituted or unsubstituted cycloalkenyl group having 3 to 30 carbon atoms, namely, a monovalent group in which one of hydrogen atoms of cycloalkene having 3 to 30 carbon atoms was eliminated. For example, it may be 2-cyclopenten-1-yl, 2-cyclohexen-1-yl), a bicycloalkenyl group (a substituted or unsubstituted bicycloalkenyl group, preferably, a substituted or unsubstituted bicycloalkenyl group having 5 to 30 carbon atoms, namely, a monovalent group in which one of hydrogen atoms of bicycloalkene which has one double bond was eliminated. For example, it may be bicyclo[2,2,1]hepto-2-en-1-yl, bicyclo[2,2,2]octo-2-en-4-yl)], an alkinyl group (preferably, a substituted or unsubstituted alkinyl group having 2 to 30 carbon atoms, for example, ethinyl, propargyl, and trimethylsilylethinyl), an aryl group (preferably, a substituted or unsubstituted aryl group having 6 to 30 carbon atoms, for example, phenyl, p-tolyl, naphthyl, m-chlorophenyl, and o-hexadecanoylaminophenyl), a hetero ring group (preferably, a monovalent group in which one hydrogen atom was eliminated from a 5- or 6-membered substituted or unsubstituted aromatic or non-aromatic hetero ring compound, and more preferably, a 5- or 6- membered aromatic hetero ring group having 3 to 30 carbon atoms. For example, it may be 2-furyl, 2-thienyl, 2-pyrimidinyl, 2-benzothiazolyl), a cyano group, a hydroxyl group, a nitro group, a carboxyl group, an alkoxy group (preferably, a substituted or unsubstituted alkoxy group having 1 to 30 carbon atoms, for example, methoxy, ethoxy, isopropoxy, t-butoxy, n-octyloxy, and 2-methoxyethoxy), an aryloxy group (preferably, a substituted or unsubstituted aryloxy group having 6 to 30 carbon atoms, for example, phenoxy, 2-methylphenoxy, 4-t-butylphenoxy, 3-nitrophenoxy, and 2-tetradecanoylaminophenoxy), a silyloxy group (preferably, a silyloxy group having 3 to 20 carbon atoms, for example, trimethylsilyloxy and t-butyldimethylsilyloxy), a hetero ring oxy group (preferably, a substituted or unsubstituted hetero ring oxy group having 2 to 30 carbon atoms, 1-phenyltetrazol-5-oxy, 2-tetrahydropiranyloxy), an acyloxy group (preferably, a formyloxy group, a substituted or unsubstituted alkylcarbonyloxy group having 2 to 30 carbon atoms, a substituted or unsubstituted arylcarbonyloxy group having 6 to 30 carbon atoms, for example, formyloxy, acetyloxy, pivaloyloxy, stearoyloxy, benzoyloxy, and p-methoxyphenylcarbonyloxy), a carbamoyloxy group (preferably, a substituted or unsubstituted carbamoyloxy group having 1 to 30 carbon atoms, for example, N,N-dimethylcarbamoyloxy, N,N-diethylcarbamoyloxy, morpholinocarbonyloxy, N,N-di-n-octylaminocarbonyloxy, and N-n-octylcarbamoyloxy), an alkoxycarbonyloxy group (preferably, a substituted or unsubstituted alkoxycarbonyloxy group having 2 to 30 carbon atoms, for example, methoxycarbonyloxy, ethoxycarbonyloxy, t-buthoxycarbonyloxy, and n-octylcarbonyloxy), an aryloxycarbonyloxy group (preferably, a substituted or unsubstituted aryloxycarbonyloxy group having 7 to 30 carbon atoms, for example, phenoxycarbonyloxy, p-methoxyphenoxycarbonyloxy, p-n-hexadecyloxyphenoxycarbonyloxy), an amino group (including an anilino group) (preferably, an amino group, a substituted or unsubstituted alkylamino group having 1 to 30 carbon atoms, a substituted or unsubstituted anilino group having 6 to 30 carbon atoms, for example, amino, methylamino, dimethylamino, anilino, N-methyl-anilino, and diphenylamino), an acylamino group (preferably, an formylamino group, a substituted or unsubstituted alkylcarbonylamino group having 1 to 30 carbon atoms, a substituted or unsubstituted arylcarbonylamino group having 6 to 30 carbon atoms, for example, formylamino, acetylamino, pivaloylamino, lauloylamino, benzoylamino, and 3,4,5-tri-n-octyloxyphenylcarbonylamino), an aminocarbonylamino group (preferably, a substituted or unsubstituted aminocarbonylamino group having 1 to 30 carbon atoms, for example, carbamoylamino, N,N-dimethylaminocarbonylamino, N,N-diethylaminocarbonylamino, and morpholinocarbonylamino), an alkoxycarbonylamino group (preferably, a substituted or unsubstituted alkoxycarbonylamino group having 2 to 30 carbon atoms, for example, methoxycarbonylamino, ethoxycarbonylamino, t-buthoxycarbonylamino, n-octadecyloxycarbonylamino, and N-methyl-methoxycarbonylamino), an aryloxycarbonylamino group (preferably, a substituted or unsubstituted aryloxycarbonylamino group having 7 to 30 carbon atoms, for example, phenoxycarbonylamino, p-chlorophenoxycarbonylamino, and m-n-octyloxyphenoxycarbonylamino), a sulfamoylamino group (preferably, a substituted or unsubstituted sulfamoylamino group having 0 to 30 carbon atoms, for example, sulfamoylamino, N,N-dimethylaminosulfonylamino, and N-n-octylaminosulfonylamino), an alkyl and arylsulfonylamino group (preferably, a substituted or unsubstituted alkylsulfonylamino having 1 to 30 carbon atoms, a substituted or unsubstituted arylsulfonylamino having 6 to 30 carbon atoms, for example, methylsulfonylamino, butylsulfonylamino, phenylsulfonylamino, 2,3,5-trichlorophenylsulfonylamino, and p-methylphenylsulfonylamino), a mercapto group, an alkylthio group (preferably, a substituted or unsubstituted alkylthio having 1 to 30 carbon atoms, for example, methylthio, ethylthio, and n-hexadecylthio), an arylthio group (preferably, a substituted or unsubstituted arylthio having 6 to 30 carbon atoms, for example, phenylthio, p-chlorophenylthio, and m-methoxyphenylthio), a hetero ring thio group (preferably, a substituted or unsubstituted hetero ring thio group having 3 to 30 carbon atoms, for example, 2-benzothiazolylthio, and 1-phenyl-tetrazol-5-ylthio), a sulfamoyl group (preferably, a substituted or unsubstituted sulfamoyl group having 0 to 30 carbon atoms, for example, N-ethylsulfamoyl, N-(3-dodecyloxypropyl) sulfonyl, N'-N-dimethylsulfamoyl, N-acetylsulfamoyl, N-benzoylsulfamoyl, and N-(N'-phenylcarbamoyl) sulfamoyl), a sulfo group, an alkyl and arylsulfinyl group (preferably, a substituted or unsubstituted alkylsulfinyl group having 1 to 30 carbon atoms, a substituted or unsubstituted arylsulfinyl group having 6 to 30 carbon atoms, for example, methylsulfinyl, ethylsulfinyl, phenylsulfinyl, and p-methylphenylsulfinyl), an alkyl and arylsulfonyl group (preferably, a substituted or unsubstituted alkylsulfonyl group having 1 to 30 carbon atoms, a substituted or unsubstituted arylsulfonyl group having 6 to 30 carbon atoms, for example, methylsulfonyl, ethylsulfonyl, phenylsulfonyl, and p-methylphenylsulfonyl), an acyl group (preferably, a formyl group, a substituted or unsubstituted alkylcarbonyl group having 2 to 30 carbon atoms, a substituted or unsubstituted arylcarbonyl group having 7 to 30 carbon atoms, for example, acetyl, pivaloyl, 2-chloroacetyl, stearoyl, benzoyl, and p-n-octyloxyphenylcarbonyl), an aryloxycarbonyl group (preferably, a substituted or unsubstituted aryloxycarbonyl group having 7 to 30 carbon atoms, for example, phenoxycarbonyl, o-chlorophenoxycarbonyl, m-nitrophenoxycarbonyl, and p-t-butylphenoxycarbonyl), an alkoxycarbonyl group (preferably, a substituted or unsubstituted alkoxycarbonyl group having 2 to 30 carbon atoms, for example, methoxycarbonyl, ethoxycarbonyl, t-buthoxycarbonyl, and n-octadecyloxycarbonyl), a carbamoyl group (preferably, a substituted or unsubstituted carbamoyl group having 1 to 30 carbon atoms, for example, carbamoyl, N-methylcarbamoyl, N,N-dimethylcarbamoyl, N,N-di-n-actylcarbonyl, and N-(methylsulfonyl) carbamoyl), an aryl and hetero ring azo group (preferably, a substituted or unsubstituted aryl azo group having 6 to 30 carbon atoms, a substituted or unsubstituted hetero ring azo group having 3 to 30 carbon atoms, for example, phenylazo, p-chlorophenylazo, and 5-ethylthio-1,3,4-thiadiazol-2-ylazo), an imido group (preferably, N-succinimide and N-phthalimide), a phosphino group (preferably, a substituted or unsubstituted phosphino group having 2 to 30 carbon atoms, for example, dimethylphosphino, diphenylphosphino, and methylphenylphosphino), a phosphinyl group (preferably, a substituted or unsubstituted phosphinyl group having 2 to 30 carbon atoms, for example, phosphinyl, dioctyloxyphosphinyl, and diethoxyphosphinyl), a phosphinyloxy group (preferably, a substituted or unsubstituted phosphinyloxy group having 2 to 30 carbon atoms, for example, diphenoxyphosphinyloxy, and dioctyloxyphosphinyloxy), a phosphinylamino group (preferably, a substituted or unsubstituted phosphinylamino group having 2 to 30 carbon atoms, for example, dimethoxyphosphinylamino, and dimethylaminophosphinylamino), and a silyl group (preferably, a substituted or unsubstituted silyl group having 3 to 30 carbon atoms, for example, trimethylsilyl, t-butyldimethylsilyl, and phenyldimethylsilyl).

Among these, $R^1$ is preferably an alkyl group, an aryl group, an alkylamino group, an anilino group, or an acylamino group, more preferably an alkyl group or an aryl group, and preferably a substituted or unsubstituted alkyl group or a substituted or unsubstituted phenyl group.

Then, $R^2$ is explained. $R^2$ represents a substituent.

The number of $R^2$ is represented by a, and a represents an integer of 0 to 4. When a is 1 or more, $R^2$ is selected from a group indicated below. When "a" is 2 or more, a plural number of $R^2$ may be the same or different. In case of a=1, $R^2$ is selected from a group in which a $\sigma p$ value is 0 to 0.53, and in case of a=2 to 4, $R^2$ is selected from a group in which the sum of the $\sigma p$ value of a plural number of $R^2$ is 0 to 0.53.

The σp value of a substituent is described in Chem. Rev. Vol. 91, pages 165–195 (1991), the disclosure of which is incorporated herein by reference.

As examples of a substituent used as $R^2$, a halogen atom, an alkyl group (including a cycloalkyl group, and a bicycloalkyl group), an alkenyl group (including a cycloalkenyl group, and a bicycloalkenyl group), an alkinyl group, an aryl group, a hetero ring group, a cyano group, a hydroxyl group, a nitro group, a carboxyl group, an alkoxy group, an aryloxy group, a silyloxy group, a hetero ring oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl and arylsulfonylamino group, a mercapto group, an alkylthio group, an arylthio group, a hetero ring thio group, a sulfamoyl group, a sulfo group, an alkyl and arylsulfinyl group, an alkyl and arylsulfonyl group, an acyl group, an aryloxycarbonyl group, an alkoxycarbonyl group, an alkylaminocarbonyl group, an arylaminocarbonyl group, a carbamoyl group, an aryl and hetero ring azo group, an imido group, a phosphino group, a phosphinyl group, a phosphinyloxy group, a phosphinylamino group, and a silyl group are mentioned.

As preferable examples of $R^2$, an acyl group (a substituted or unsubstituted acyl group, for example, acetyl, propionyl, trifluoroacetyl, benzoyl, pivaloyl and the like), an alkoxycarbonyl group (a substituted or unsubstituted alkoxycarbonyl group, for example, methoxycarbonyl, ethoxycarbonyl, n-hexyloxycarbonyl, trifluoromethoxycarbonyl, n-octadecyloxycarbonyl and the like), an aryloxycarbonyl group (a substituted or unsubstituted aryloxycarbonyl group, for example, phenoxycarbonyl, 2-chlorophenoxycarbonyl, 4-dodecyloxyphenoxycarbonyl, 2-octyloxyphenoxycarbonyl and the like), an alkylaminocarbonyl group (a substituted or unsubstituted alkylaminocarbonyl group, for example, N,N-diethylaminocarbonyl, N-dodecylaminocarbonyl, N,N-dioctylaminocarbonyl, N,N-dipentafluoroethylaminocarbonyl, and the like), and an arylaminocarbonyl group (a substituted or unsubstituted aryloxycarbonyl group, for example, anilinocarbonyl, N-methyl-2-dodecyloxyanilinocarbonyl, 2,4,6-trichloroanilinocarbonyl, N-ethyl-4-nonylanilinocarbonyl, and the like) are mentioned.

In particular, a=1 is preferable, and as $R^2$, an alkoxycarbonyl group, an aryloxycarbonyl group, an alkylaminocarbonyl group, and an arylaminocarbonyl group are used. Those in which the total carbon numbers of these groups are 5 to 40 are preferably used.

Then, $R^3$ and $R^4$ are explained.

Each of $R^3$ and $R^4$ independently represents a hydrogen atom or a substituent. As examples when $R^3$ and $R^4$ are substituents, an alkyl group (including a cycloalkyl group and a bicycloalkyl group), an alkenyl group (including a cycloalkenyl group and a bicycloalkenyl group), an alkinyl group, an aryl group, a hetero ring group, a carboxyl group, an alkoxy group, an aryloxy group, a silyloxy group, a hetero ring oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl and arylsulfonylamino group, an acyl group, an aryloxycarbonyl group, an alkoxycarbonyl group, a carbamoyl group, and a silyl group are mentioned. These substituents are selected from the similar substituent groups as those which were mentioned as a group which the fore-mentioned $R^1$ can take. Furthermore, these substituents may be further substituted by a group which was shown as a group which the fore-mentioned $R^1$ can take.

$R^3$ and $R^4$ are preferably a hydrogen atom, an alkyl group (including a cycloalkyl group and a bicycloalkyl group), an alkenyl group (including a cycloalkenyl group and a bicycloalkenyl group), an alkinyl group, an aryl group, and a hetero ring group. A hydrogen atom, an alkyl group and an aryl group are further preferable, and a hydrogen atom and an alkyl group are more preferable. At least one of $R^3$ and $R^4$ is preferably a hydrogen atom, and both of $R^3$ and $R^4$ are most preferably a hydrogen atom.

Then, $R^5$ is explained. $R^5$ represents an organic group which is bonded with a sulfur atom by a $sp^3$ carbon. In other words, $R^5$ represents a group which is bonded with S by a carbon atom, and said carbon atom is bonded with another substituent on said carbon atom by a single bond. $R^5$ represents a group which expresses a desilverization accelerating property as time-S—$R^5$ or —S—$R^5$. $R^5$ is preferably represented by the following general formula (III):

$$^{**}\text{—CRR'—(Q)m—B} \qquad \text{(III)}$$

Where each of R and R' independently represents a hydrogen atom or a substituent. R and R' may be mutually bonded and form a ring. Q represents a divalent group, m represents 0 or 1, B represents a group (or a metal salt thereof) selected from —$OR^{12}$, —COOH, —$SO_3H$, —$NR^{12}R^{13}$, —$CONR^{12}R^{13}$, —$SO_2NR^{12}R^{13}$, and —$SO_2NHCOR^{12}$, —$NR^{12}CONR^{13}R^{14}$, and each of $R^{12}$, $R^{13}$ and $R^{14}$ independently represents a hydrogen atom or an alkyl group or an aryl group having 1 to 10 carbon atoms. $R^{12}$, $R^{13}$ and $R^{14}$ may further have a substituent, and $R^{12}$ and $R^{13}$, or $R^{13}$ and $R^{14}$ are mutually bonded and may form a saturated or unsaturated carbon ring or hetero ring. ** in the formula represents a site which is bonded with a sulfur atom.

General formula (III) is further explained in detail below.

Firstly, R and R' are explained. Each of R and R' independently represents a hydrogen atom or a substituent. As the substituent, an alkyl group, an alkenyl group, an alkinyl group, an aryl group, a hetero ring group, a carboxyl group (or a salt thereof), a sulfo group(or a salt thereof), an alkoxycarbonyl group, a carbamoyl group, a sulfamoyl group and the like are used. An alkyl group, an alkenyl group, an alkinyl group, an aryl group, a hetero ring group, an alkoxycarbonyl group, a carbamoyl group and a sulfamoyl group which R and R' can take are selected from the similar groups as those which $R^1$ in general formula (I) can take. Further, these groups may be further substituted with the similar groups as those which $R^2$ can take. A group having 1 to 10 carbon atoms is preferably used as R and R', and a group having 1 to 6 carbon atoms is further preferably used. A hydrogen atom, a methyl group, a hydroxymethyl group, a carboxyl group and a sulfo group are preferably used as R and R' in particular. The combination of R and R' is preferably R=H and R'=H: R=H and R'=$CH_3$: R=H and R'=$CH_2OH$: R=H and R'=COOH: R=H and R=$SO_3H$:, and preferably R=R'=H in particular.

Then, Q is explained.

The divalent group represented by Q may be any group, but as the preferable divalent group, —$C_kH_{2k-1}R^{15}{}_l$— (k represents a natural number of 1 or more and 20 or less, and l represents an integer of 0 or more and 40 or less), —O—, —S—, —CO—, —$NR^{16}$—, —$SO_2$—, a phenylene group, a hetero ring group, (for example, 2,4-imidazolyl, 2,5-thiazolyl, 3,5-(1,2,4)-triazolyl and the like), and a combination of these groups are mentioned. $R^{15}$ represents a substituent, $R^{16}$ represents a hydrogen atom or a substituent. As a preferable group which is represented by $R^{15}$, an alkyl group, an aryl group, a halogen atom, an alkoxy group, a hydroxyl group (or a salt thereof), a carboxyl group (or a salt thereof), a sulfo group (or a salt thereof) and an amino group are mentioned. When 1 is 2 or more, a plural number of $R^{15}$'s may be the same or different. When $R^{16}$ is a substituent, an alkyl group and an aryl group are mentioned as a preferable group.

As the preferable Q, —$C_kH_{2k-1}R^{15}{}_l$— with k of 1 or more and 5 or less and l of 0 or more and 5 or less, —O—, —S—, —$NR^{16}$—, and a combination thereof are mentioned. In particular, a group in which k is 1 or more and 5 or less in —$C_kH_{2k-1}R^{15}{}_l$— and 1 is 0 or 1 is preferable.

Then, B is explained.

B represents a group selected from —$OR^{12}$, —COOH, —$SO_3H$, —$NR^{12}R^{13}$, —$CONR^{12}R^{13}$—$SO_2NR^{12}R^{13}$, —$SO_2NHCOR^{12}$, and —$NR^{12}CONR^{13}R^{14}$, and each of $R^{12}$, $R^{13}$ and $R^{14}$ independently represents a hydrogen atom, or an alkyl group having 1 or more and 10 or less carbon atoms or an aryl group.

Among these, when $R^{12}$, $R^{13}$ and $R^{14}$ are an alkyl group or an aryl group, each of them is preferably an alkyl group having 1 to 6 carbon atoms or an aryl group, and more preferably an alkyl group having 3 or less carbon atoms. Further, it is preferable that the sum of $R^{12}$, $R^{13}$ and $R^{14}$ is 10 or less, and more preferably 6 or less.

As the preferable group as B, —$OR^{12}$, —COOH, —$SO_3H$, —$NR^{12}R^{13}$ and —$CONR^{12}R^{13}$, and when it is —$OR^{12}$, $R^{12}$ is preferably a hydrogen atom. When it is —$NR^{12}R^{13}$, a group in which the sum of carbon numbers of $R^{12}$ and $R^{13}$ is preferably 6 or less.

It is preferable that the molecular weight of a portion represented by general formula (III) is 300 or less, and more preferably 200 or less. The preferable combination of Q and B as a group represented by general formula (III) is a combination in which Q is —$C_kH_{2k-1}R^{15}{}_l$— with k of 1 or more and 5 or less, l is 0 or 1, B is —OH, —COOH, —$SO_3H$, and —$NR^{12}R^{13}$ (the total carbon numbers of $R^{12}$ and $R^{13}$ is 6 or less), and m is 1.

Specific examples which are preferable as the group represented by general formula (III) are mentioned, but the present invention is not limited to these.

1.

**—$CH_2CH_2CO_2H$

2.

**—$CH_2CH_2CH_2CO_2H$

3.

**—$CH_2CO_2H$

4.

**—$CH_2CH(CO_2H)_2$

5.

**—$CH_2CH_2CH_2CH_2CO_2H$

6.

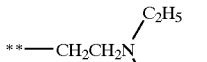

-continued

7.

8.

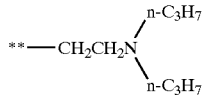

9.

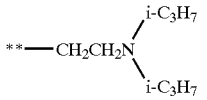

10.

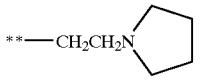

11.

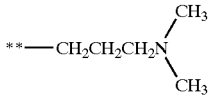

12.

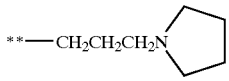

13.

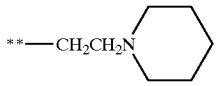

14.

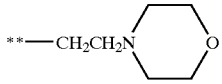

15.

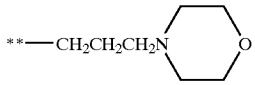

16.

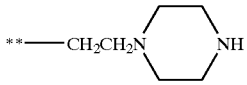

17.

**—$CH_2CH_2CH_3NHCH_2CH_2CH_3$

18.

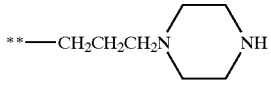

19.

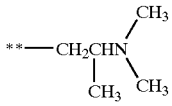

20.

**—$CH_2CH_2CH_2NH_2$

21.

**—$CH_2CH_2CH_2CH_2NH_2$

22.

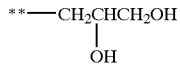

23.

**—$CH_2CH_2OH$

-continued

24.
$**—CH_2CH(OH)CH_2NHCH_3$

25.
$**—CH_2CH(OH)—CH(OH)—CH_2OH$

26.
$**—CH_2CH_2SO_3Na$

27.
$**—CH_2CH_2CH_2SO_3Na$

28.
$**—CH_2CH_2SO_3H$

29.
$**—CH_2CH_2CH_2CH_2SO_3H$

30.
$**—CH_2CH(OH)CH_2SO_3H$

31.
$**—CH_2CH_2CH(CH_3)SO_3H$

32.
$**—CH_2CH_2CH_2CH(OH)SO_3Na$

33.
$**—CH_2CH(OH)CH_2SO_3K$

34.
$**—CH_2CH_2OCH_2CH_2N(CH_3)_2$

35.
$**—CH_2CH_2SCH_2CH_2N$ (morpholine)

36.
$**—CH_2CH_2OCH_2CH_2N$ (morpholine)

37.
$**—CH_2CH_2SCH_2CH_2SCH_2CH_2N(C_2H_5)_2$

38.
$**—CH_2CH_2C(CH_3)_2SO_3H$

39.
$**—CH_2CH_2OCH_2CH_2SH$

40.
$**—CH_2CH_2N(CH_2CH_2SH)_2$

41.
$**—CH_2CH_2N(CH_2CH_2OH)_2$

42.
$**—CH_2CH_2OCH_2CH_2N$ (pyrrolidine)

43.
$**—CH_2CH_2NHCOCH_3$

-continued

44.
$**—CH_2CH_2CH_2NHCOCH_3$

45.
$**—CH_2CH_2NHCOCH_2N(CH_3)_2$

46.
$**—CH_2CH_2OCH_2CH_2NHCOC_6H_5$

47.
$**—CH_2CH_2CH_2O_2CCH_3$

48.
$**—CH_2CH_2NHSO_2CH_3$

49.
$**—CH_2CH(NH_2)CO_2H$

50.
$**—CH_2CONHCH_3$

51.
$**—CH_2CONHCH_2OH$

52.
$**—CH_2CH_2CONH_2$

53.
$**—CH_2CH_2CH(NH_2)CO_2H$

54.
$**—C(CH_3)_2CH(NH_2)CO_2H$

55.
$**—CH(CH_3)NHCH_2CO_2H$

56.
$**—CH_2CON(CH_3)OH$

Then, Time is explained.

Time may be any of groups having property by which the scission of the bond between Time and S—$R^5$ occurs after breaking away as $(Time)_t$-S—$R^5$ from a compound represented by general formula (I).

As examples of the preferable Time, the following formulae (1) to (25) can be mentioned.

Further, * in the formulae represents a bonding site with a carbon atom which was substituted with $R^3$ and $R^4$ and ** represents a bonding site with a sulfur atom.

1.
(*)—O—C6H4—CH2—N(C2H5)—C(=O)—(*)(*)

-continued
2.
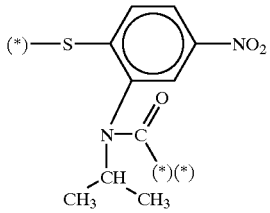
3.
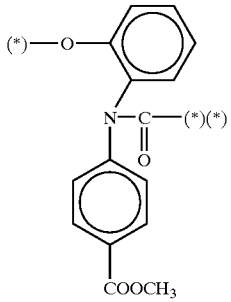
4.
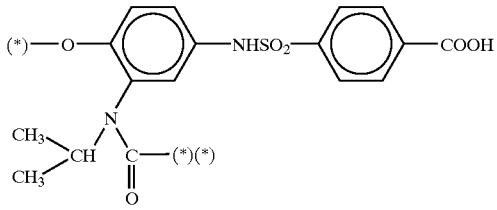
5.
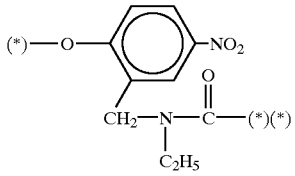
6.
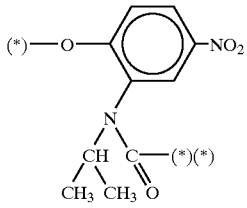
7.
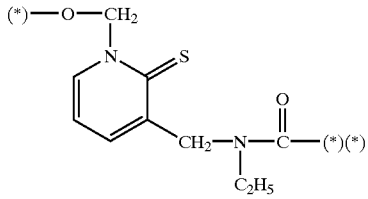
8.
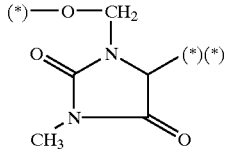
-continued
9.
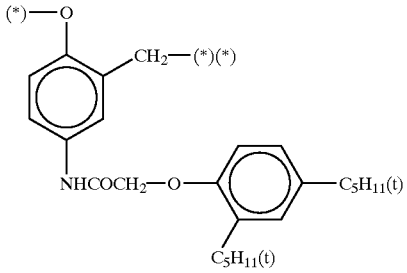
10.
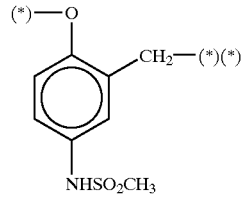
11.
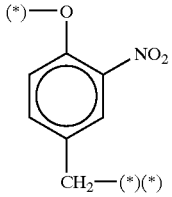
12.
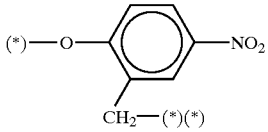
13.
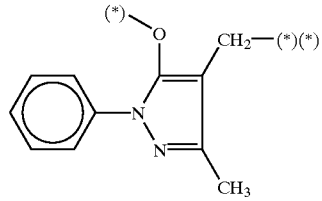
14.
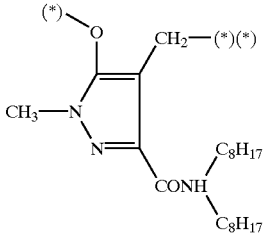
15.
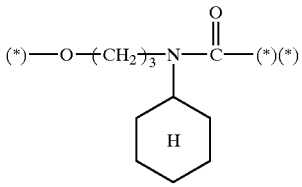

-continued

16.

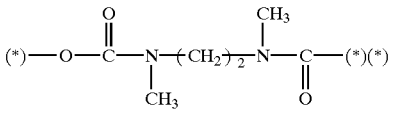

17.

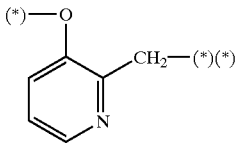

18.

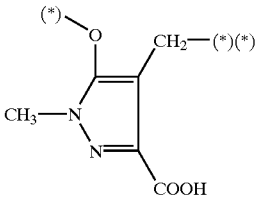

19.

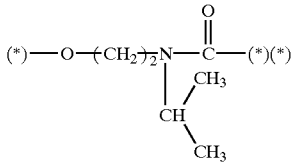

20.

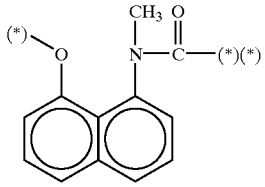

21.

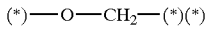

22.

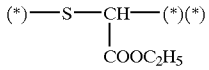

23.

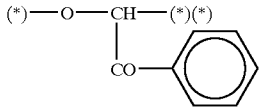

24.

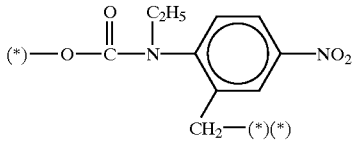

25.

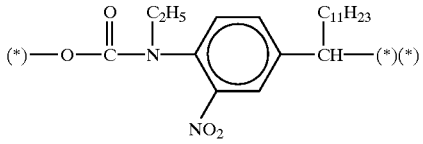

A compound represented by general formula (II) can be mentioned as a preferable compound among compounds represented by general formula (I).

$R^6$, $R^9$ and $R^{10}$ in general formula (II) respectively represent the similar group as $R^1$, $R^3$ and $R^4$ in general formula (I).

$R^7$ is a group selected from an acyl group, an alkoxycarbonyl group, an aryloxycarbonyl group, a carbamoyl group, an alkylaminocarbonyl group, and an arylaminocarbonyl group. b represents an integer of 0 to 3. $R^8$ is a substituent, and when b is 2 or 3, it can take a group being the same or different. When b is 0, $R^8$ is of course a hydrogen. Further, the total of the σp value of $R^7$ and the σp value of $R^8$ is 0 to 0.53. $R^{11}$ represents an organic group which is bonded with a sulfur atom by a $sp^3$ carbon.

$R^7$ is explained in detail. $R^7$ is a group selected from an acyl group (preferably, a formyl group, a substituted or unsubstituted alkylcarbonyl group having 2 to 30 carbon atoms, a substituted or unsubstituted arylcarbonyl group having 7 to 30 carbon atoms, for example, acetyl, pivaloyl, 2-chloroacetyl, stearoyl, benzoyl, and p-n-octyloxyphenylcarbonyl), an aryloxycarbonyl group (preferably, a substituted or unsubstituted aryloxycarbonyl group having 7 to 30 carbon atoms, for example, phenoxycarbonyl, o-chlorophenoxycarbonyl, m-nitrophenoxycarbonyl, and p-t-butylphenoxycarbonyl), an alkoxycarbonyl group (preferably, a substituted or unsubstituted alkoxycarbonyl group having 2 to 30 carbon atoms, for example, methoxycarbonyl, ethoxycarbonyl, t-buthoxycarbonyl, and n-octadecyloxycarbonyl), a carbamoyl group, an alkylaminocarbonyl group (preferably, a substituted or unsubstituted alkylaminocarbonyl group having 1 to 30 carbon atoms, for example, N-methylaminocarbonyl, N,N-dimethylaminocarbonyl, and N,N-di-n-octylaminocarbonyl), and an arylaminocarbonyl group (preferably, a substituted or unsubstituted aryl group having 1 to 30 carbon atoms, for example, N-phenylaminocarbonyl, N-(2-dodecyloxyphenyl)aminocarbonyl, and N-(4-dodecyloxycarbonylphenyl)aminocarbonyl).

In particular, an alkoxycarbonyl group, an alkylaminocarbonyl group, and an arylaminocarbonyl group are preferably used as $R^7$. A group in which the whole carbon numbers of these groups are 5 to 30 is preferably used.

Then, $R^8$ is explained. $R^8$ represents a group which $R^2$ of general formula (I) can take. $R^8$ exists by b pieces, and b represents an integer of 0 to 3. However, when $R^8$ is a substituent and b is 2 or 3, it can take the same or different one. Further, the total of the σp value of $R^7$ and the σp value of $R^8$ is 0 to 0.53.

When b is 1 or more, $R^8$ is preferably an alkyl group having 1 to 3 carbon atoms, an aryl group, an alkoxy group, an aryloxy group, an acylamino group, an alkylthio group, and an arylthio group in particular. b=0 is most preferable.

$R^{11}$ in general formula (II) is a group which the same definition as $R^5$ in general formula (I), and $R^{11}$ is bonded with a carbon atom which was substituted with $R^9$ and $R^{10}$ through a sulfur atom.

The present invention is explained mentioning the specific Examples ((1) to (55)) of the compound represented by general formula (I) (including the compound represented by general formula (II). Hereinafter, simply referred to as "the compound of the present invention"), but the present invention is not limited to these specific examples.

(1)
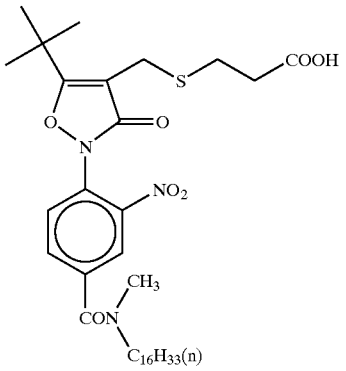
(2)
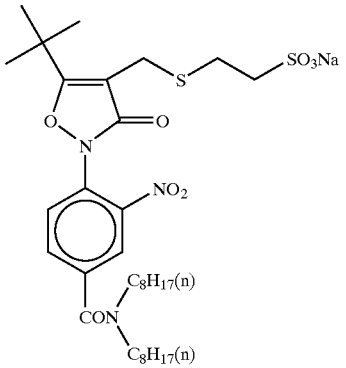
(3)
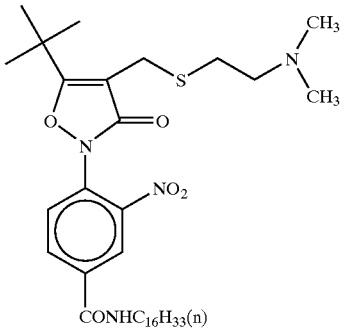
(4)
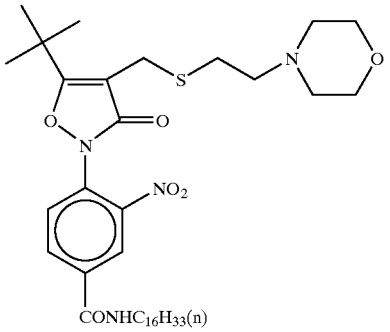
-continued
(5)
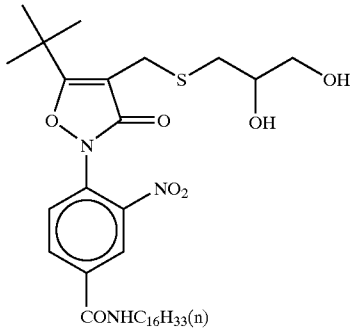
(6)
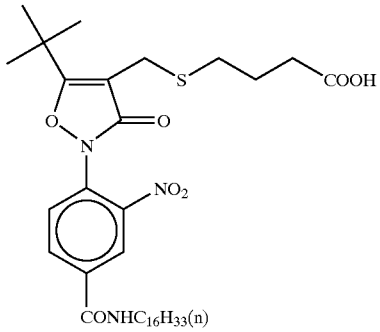
(7)
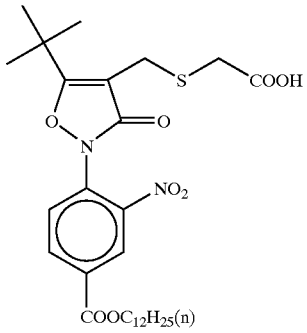
(8)
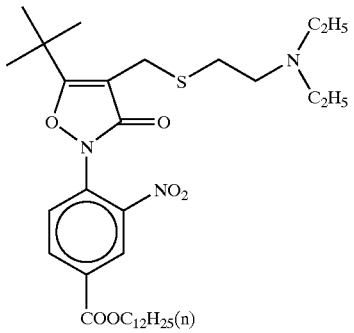

-continued
(9)
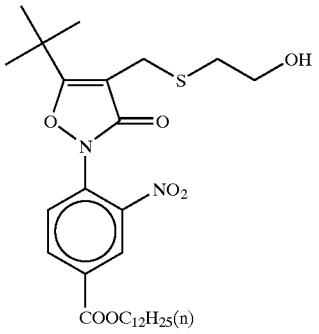
(10)
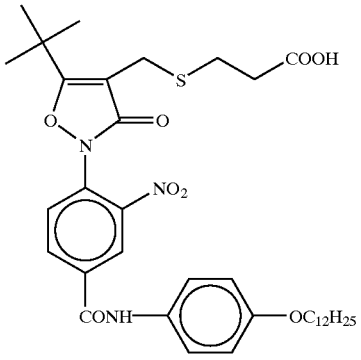
(11)
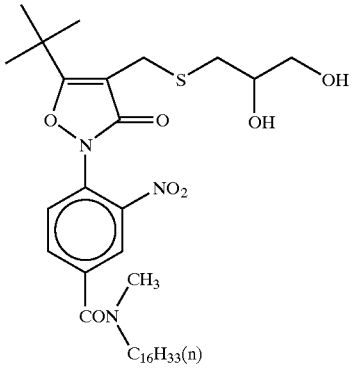
(12)
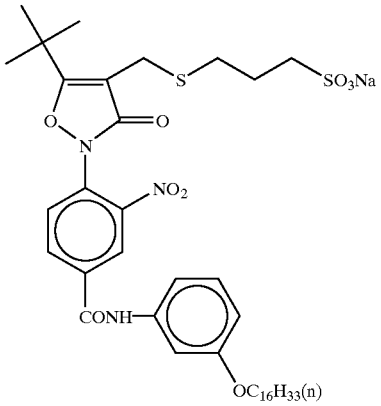
-continued
(13)
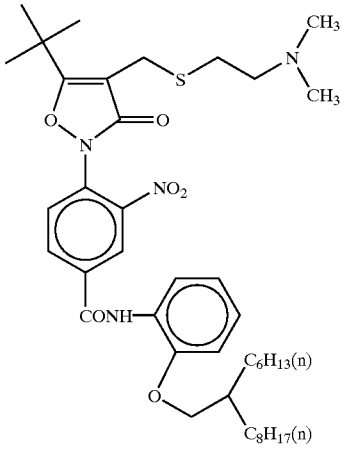
(14)
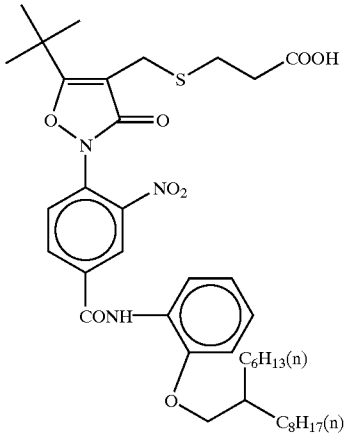
(15)
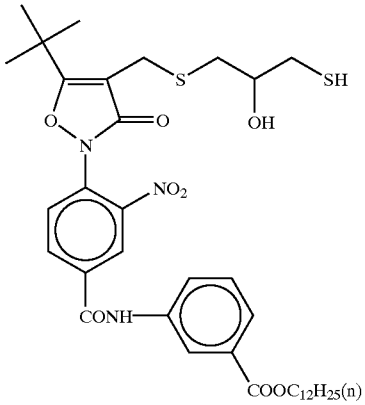
(16)
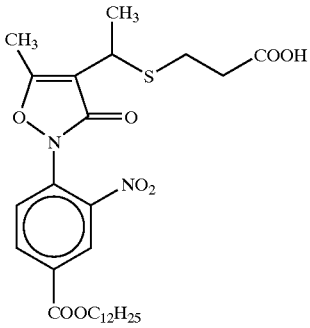

-continued
(17)
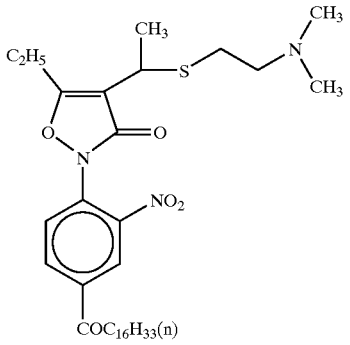
(18)
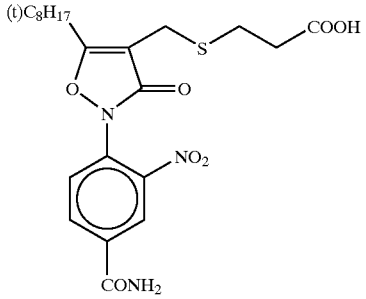
(19)
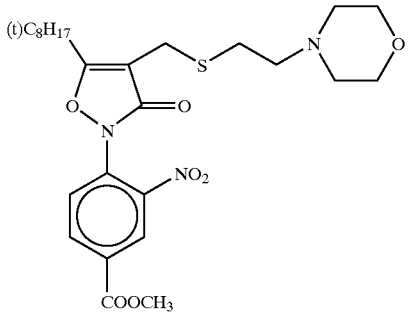
(20)
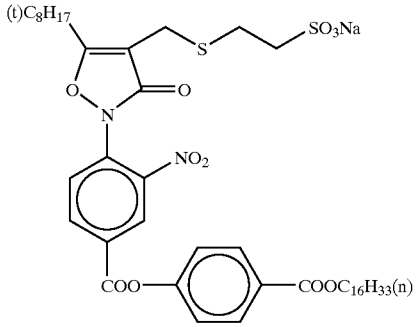
(21)
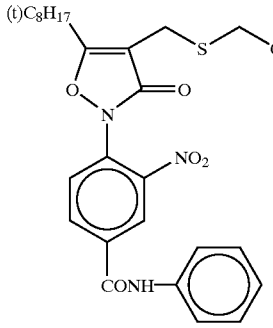
-continued
(22)
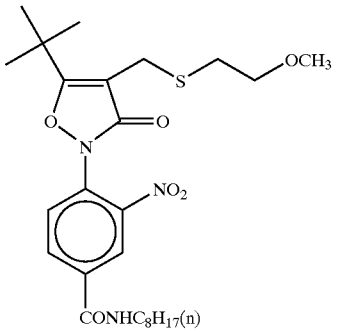
(23)
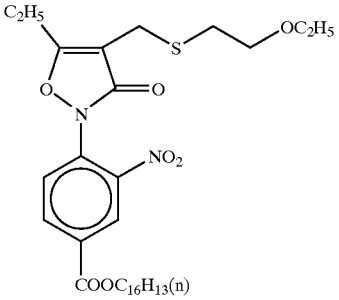
(24)
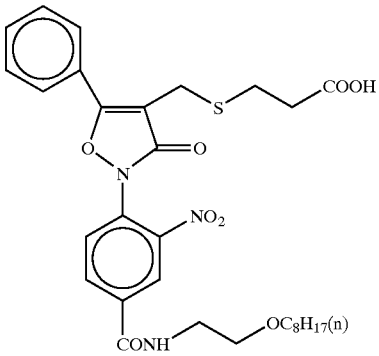
(25)
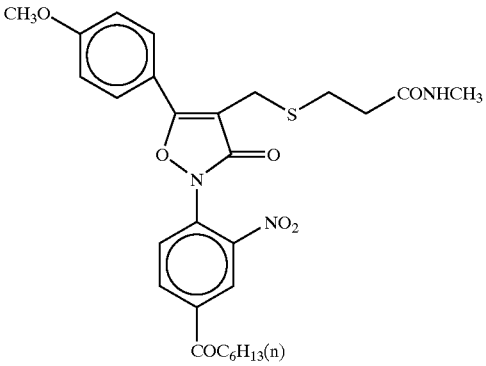

-continued
(26)
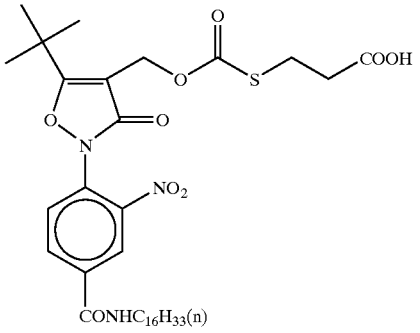
(27)
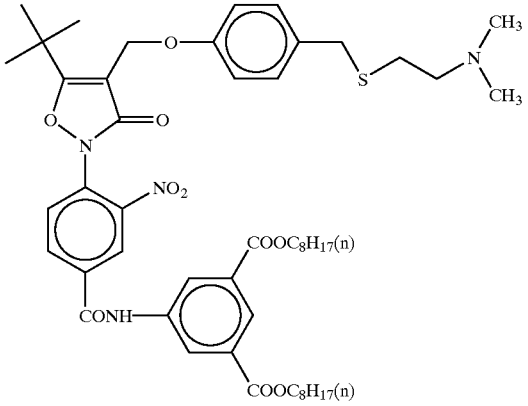
(28)
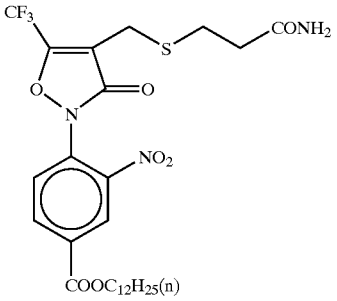
(29)
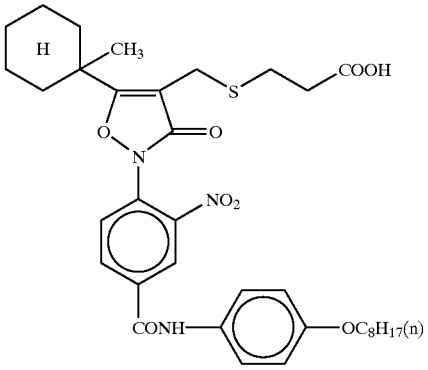
-continued
(30)
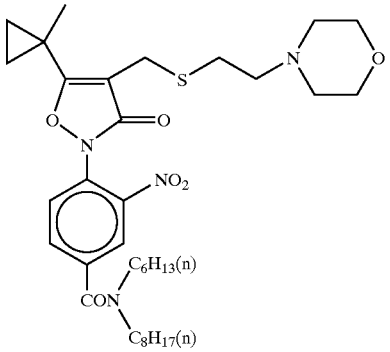
(31)
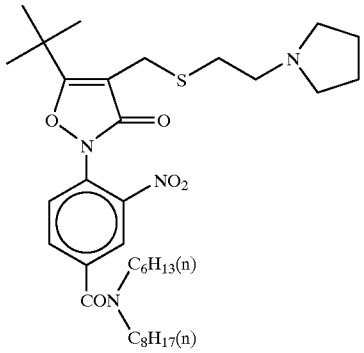
(32)
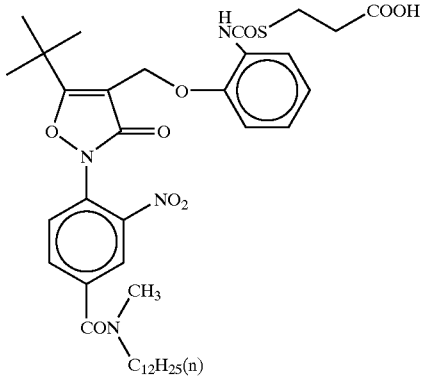
(33)
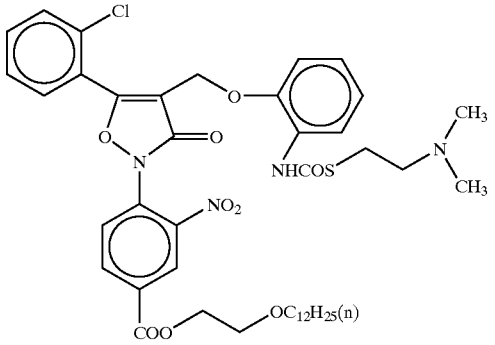

-continued
(34)
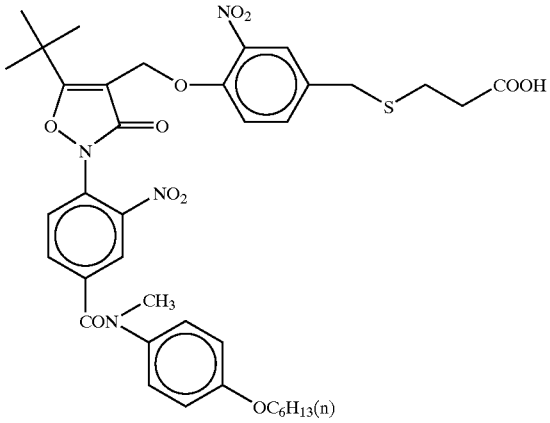
(35)
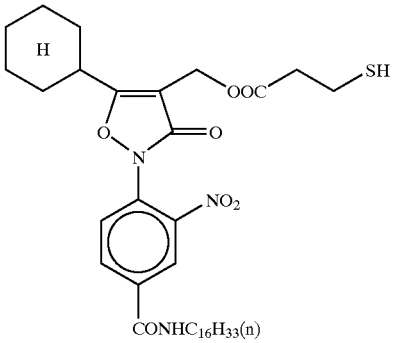
(36)
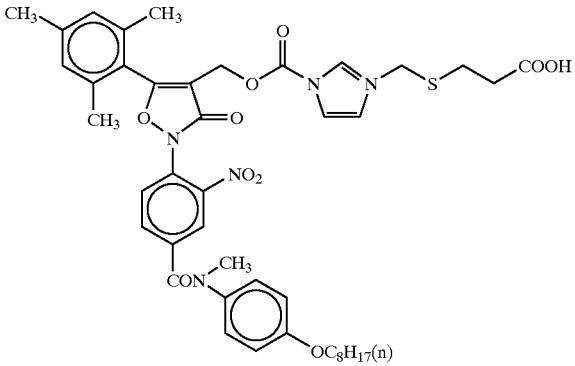
(37)
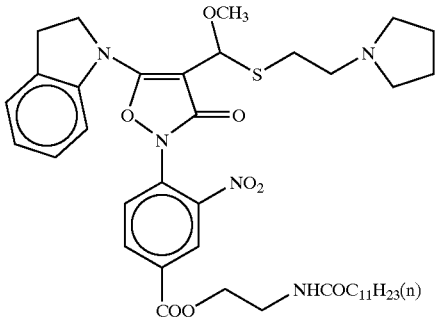
-continued
(38)
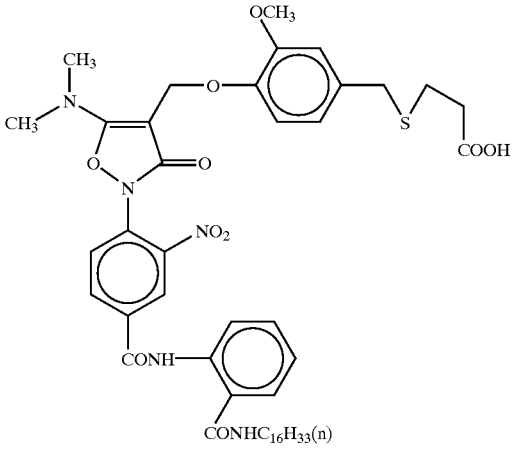
(39)
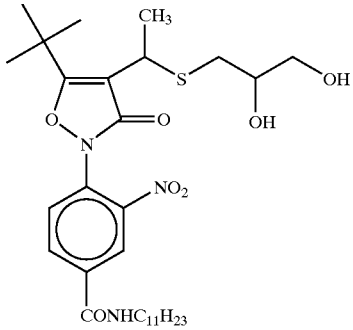
(40)
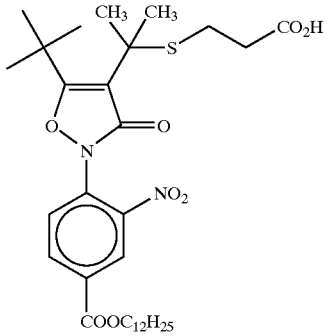
(41)
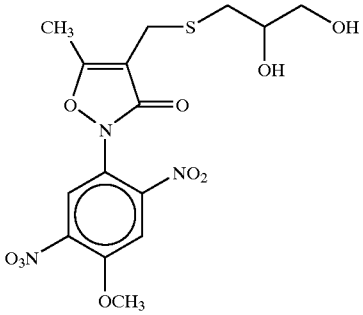

-continued
(42)
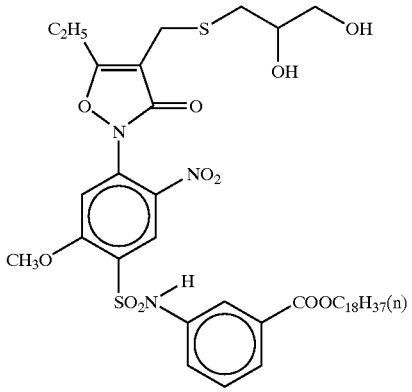
(43)
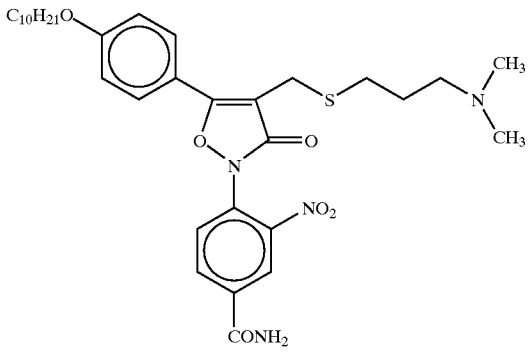
(44)
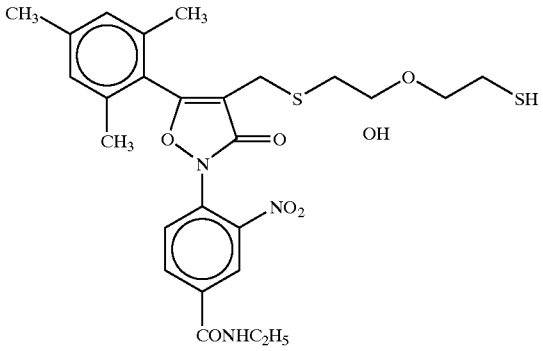
(45)
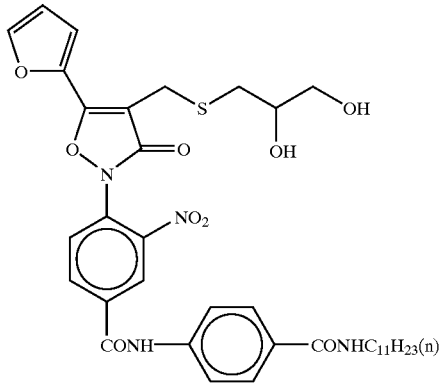
-continued
(46)
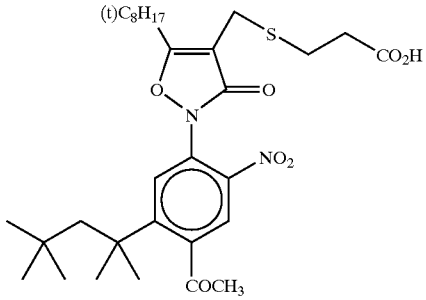
(47)
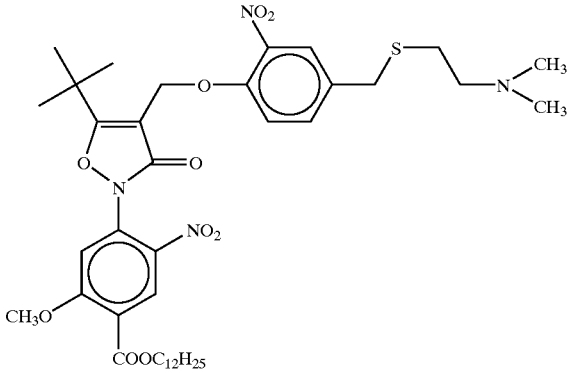
(48)
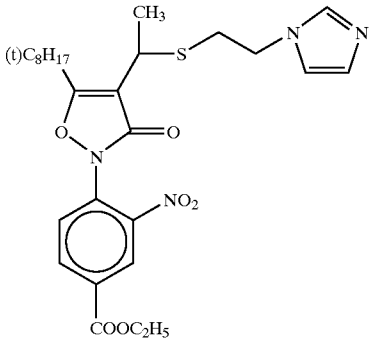
(49)
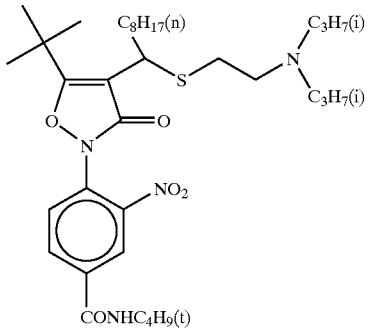

-continued (50)

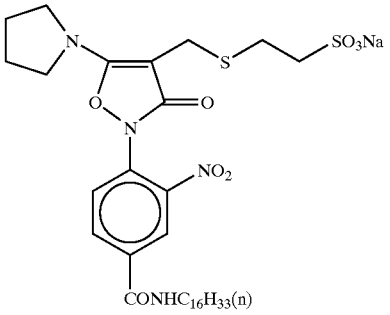

(51)

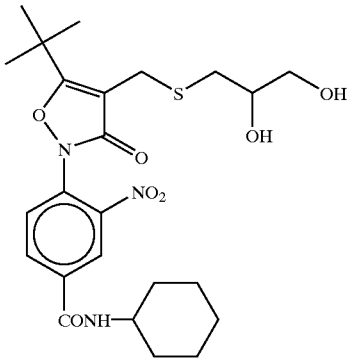

(52)

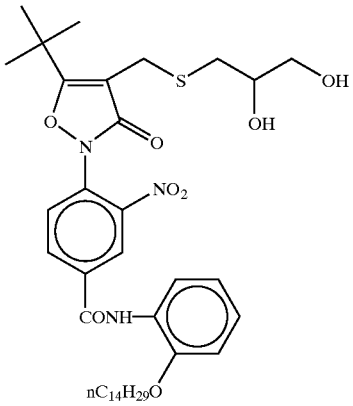

(53)

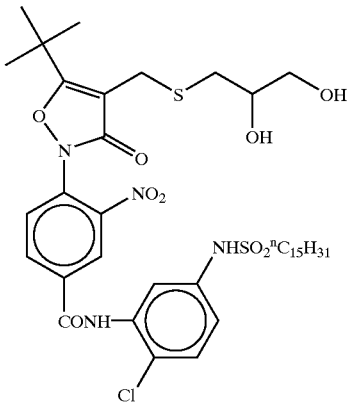

-continued (54)

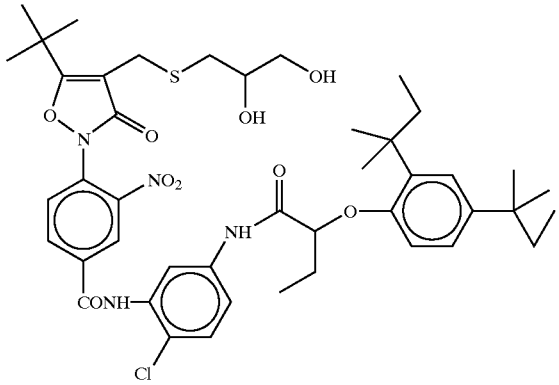

(55)

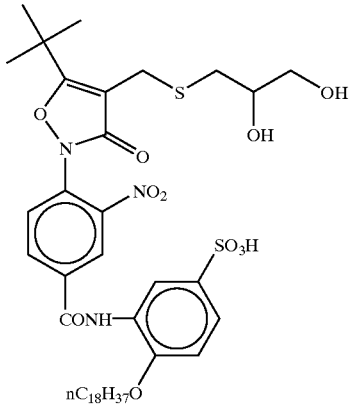

Synthesis Examples of the compound represented by general formula (I) or (II) of the present invention are shown below.

SYNTHESIS EXAMPLE 1

Synthesis of Compound 5

5-t-butyl-4-chloromethyl-2-{4-N-hexadecylcarbamoyl-2-nitrophenyl}isoxazolin-3-on (11.5 g, 20 mmol) and thioglycerol (3.2 g, 30 mmol) are dissolved in 30 mL of dimethylacetamide, triethylamine (3.0 g, 30 mL) is added at room temperature and the mixture is stirred for 2 hours. After treating with a diluted hydrochloric acid, the crude product obtained by drying and condensing with ethyl acetate was purified with silica gel column chromatography, and 10.8 g (yield: 83%) of the title compound was obtained as a light yellow amorphous solid.

SYNTHESIS EXAMPLE 2

Synthesis of Compound 14

5-t-butyl-4-chloromethyl-2-{4-N-[2-(i-hexadecyloxy)phenyl]carbamoyl-2-nitrophenyl}isoxazolin -3-on (6.7 g, 10 mmol) and mercaptopropionic acid (2.1 g, 20 mmol) are dissolved in dimethylacetamide (20 mL), triethylamine (3.0 g, 30 mL) is added at room temperature and the mixture is stirred for 4 hours. After treating with a diluted hydrochloric acid, the reaction mixture was extracted with ethyl acetate, dried and concentrated to obtain a crude product. When the crude product was recrystallized from ethyl acetate/hexane, 6.0 g (yield: 81%) of the title compound was obtained as a light yellow powder.

The lightsensitive material of the present invention contains at least one of the compounds represented by general formula (I) (preferably, the compound represented by general formula (II) in particular).

The compound represented by general formula (I) can be added to a silver halide emulsion layer or another hydrophilic colloid layer. It is preferable that the added layer is within a range of a half of film thickness which is close to a support, among the total of the emulsion layers of the lightsensitive material. The added layer may be a lightsensitive emulsion layer or a non-lightsensitive emulsion layer, but preferably the non-lightsensitive emulsion layer.

The preferable amount of the compound represented by general formula (I) which is added is 0.01 mg to 1000 mg per 1 $m^2$ of the lightsensitive material, and further preferably 1.0 mg to 200 mg. It is also preferable to use the compound of the present invention in combination of a plural number of kinds.

As the method of introducing the compound of general formula (I) of the present invention in the lightsensitive material, it is preferable that it is dissolved in a high-boiling organic solvent and added by being emulsified and dispersed using a surface active agent, or it is dispersed in fine crystals or amorphous solid state to be added.

When the compound is dissolved in the high-boiling organic solvent, another organic solvent (for example, ethyl acetate, butyl acetate, methanol, ethanol, isopropanol, methyl ethyl ketone, cyclohexanone, dimethylformamide, dimethylacetamide and the like) may be used in combination in order to aid dissolution and the like.

The high-boiling organic solvent which can be used in combination with the compound of the present invention may be liquid, solid, or any type at normal temperature, but phosphoric acid esters (for example, tricresyl phosphate, triphenyl phosphate, trihexyl phosphate, tricyclo-octyl phosphate, tricyclopentyl phosphate, trioctyl phosphate, tricyclohexyl phosphate, tri(2-ethylhexyl) phosphate, tri(3-methyl-5-dimethylhexyl) phosphate, and the like), phthalic acid esters (for example, dibutyl phthalate, dicyclohexyl phthalate, bis(2-ethylhexyl) phthalate, dioctyl phthalate, dihexyl phthalate, and the like), and carboxylic acid amides (for example, N,N-diethyllauryl amide, N,N-dimethylpalmitoyl amide, N,N-dimethyloleyl amide, and the like) are preferable, and phosphoric acid esters are preferable in particular.

It is preferable that a mass ratio of the high-boiling organic solvent which can be used in combination with the compound of the present invention to the compound of the present invention is 0.1-fold to 100-fold, and it is preferably used by 2-fold to 10-fold in particular. A plural number of the high-boiling organic solvent may be used in combination, and in order to improve the stability of the emulsified dispersion and the like, compounds (for example, an ultraviolet absorbent, an image forming coupler, a mix color preventive, a non water-soluble polymer, a fading preventive and the like) which are known in photographic field other than the compound of the present invention may be emulsified to be dispersed in the presence of the compound of the present invention.

The compound represented by general formula (I) of the present invention discharges a group having a function of accelerating desilverization by being reacted with a reductive substance. Here at, the reductive substance used in the reaction may be a compound contained in a processing solution, or a compound added in the lightsensitive material (or, an active species generated from a compound contained in the lightsensitive material by action of the processing solution). The reductive compound is preferably added in the lightsensitive material.

When the reductive compound exists in the lightsensitive material, it may exist in the same or different layer as the compound represented by general formula (I). The added layer may be any layer in the lightsensitive material, but it is preferable that it is added within a range of a half of film thickness which is close to a support, among the total of the emulsion layers of the lightsensitive material. It is preferably used by being added in the same hydrophilic colloid layer as the compound represented by general formula (I).

The preferable addition amount of the reductive compound used is preferably 0.1 mol to 100 mol per 1 mol of the compound represented by general formula (I), and more preferably 0.5 mol to 10 mol.

As the method of introducing the reductive compound in the lightsensitive material, a similar procedure as the method of introducing the compound represented by general formula (I) in the light-sensitive material can be used.

As the reductive compound, a compound represented by general formula (R-I) is mentioned. Here at, the compound represented by general formula (R-I) will be explained.

$$A^1\text{-}G^1\text{-}(L)n\text{-}G^2\text{-}A^2 \qquad \text{(R-1)}$$

Each of $G^1$ and $G^2$ in general formula (R-I) independently represents —O— or —$NR^{20}$—, and $R^{20}$ represents a hydrogen atom or a substituent. Each of $A^1$ and $A^2$ independently represents a hydrogen atom or a group which is hydrolyzed under an alkaline condition and can be removed, L represents a single bond, a vinylene group or an arylene group, and in case of a vinylene group or an arylene group, L may have a substituent. n represents an integer of 1 or more.

As examples of the group represented by $A^1$ and $A^2$ which is hydrolyzed under an alkaline condition and can be removed, an acyl group (a substituted or unsubstituted acyl group; for example, acetyl, propionyl, trifluoroacetyl, monochloroacetyl, acetoacetyl, and the like), an alkoxycarbonyl group (a substituted or unsubstituted alkoxycarbonyl group; for example, methoxycarbonyl, monochloromethoxycarbonyl, methoxyethoxycarbonyl, and the like), and an aryloxycarbonyl group (a substituted or unsubstituted aryloxycarbonyl group; for example, phenoxycarbonyl, 2-chlorophenoxycarbonyl, 2-methoxyphenoxycarbonyl, 4-N,N-dimethylaminophenoxycarbonyl, and the like), are mentioned.

Both of $A^1$ and $A^2$ are preferably hydrogen atoms.

$R^{20}$ represents a hydrogen atom or a substituent, but when it is a substituent, an alkyl group and an aryl group are most preferable.

Among the compounds represented by general formula (I), the following general formulae (R-II) and (R-III) can be mentioned as the most preferable compound.

(R-II)

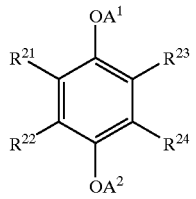

(R-III)

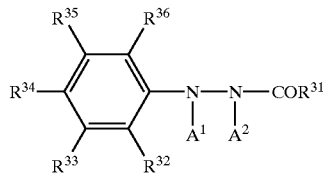

First, general formula (R-II) is explained.

In the formula of general formula (R-II), $A^1$ and $A^2$ have the same meaning as general formula (R-I).

Each of $R^{21}$, $R^{22}$, $R^{23}$ and $R^{24}$ independently represents a hydrogen atom or a substituent, but the whole of general formula (R-II) has a substituent in which molecular weight is 300 or more.

When $R^{21}$, $R^{22}$, $R^{23}$ and $R^{24}$ are substituents, a group mentioned as the substituent in the explanation of $R^2$ of general formula (I) is mentioned as examples of the substituent.

The preferable substituents as $R^{21}$, $R^{22}$, $R^{23}$ and $R^{24}$ are a halogen atom, an alkyl group, an aryl group, an alkoxy group, an aryloxy group, an acyl group, an acylamino group, an alkylthio group, an arylthio group, an aminocarbonylamino group, an alkoxycarbonyl group, a carbamoyl group, a sulfo group, and a carboxyl group, but it is preferable that at least one of $R^{21}$, $R^{22}$, $R^{23}$ and $R^{24}$ is a halogen atom.

As the preferable compound among general formula (R-II), (i) a compound in which $R^{21}$ and $R^{23}$ are substituted or unsubstituted alkyl groups, and $R^{22}$ and $R^{24}$ are hydrogen atoms, (ii) a compound in which $R^{21}$ is a substituted or unsubstituted alkyl group, and $R^{22}$, $R^{23}$ and $R^{24}$ are hydrogen atoms, (iii) a compound in which $R^{21}$ is a substituted or unsubstituted alkyl group, $R^{22}$ and $R^{24}$ are hydrogen atoms, and $R^{23}$ is a group selected from a halogen atom, an alkoxy group, an acylamino group and a sulfo group, and (iv) a compound in which $R^{21}$ is a group selected from an acylamino group, an alkoxy group, an alkylthio group, an alkylcarbonylamino group, an arylaminocarbonyl group, an alkoxycarbonylamino group and an aryloxycarbonylamino group, and $R^{22}$, $R^{23}$ and $R^{24}$ are hydrogen atoms, are mentioned. It is preferable to use these in combination.

Then, general formula (R-III) is explained.

In the formula, each of $R^{31}$, $R^{32}$, $R^{33}$, $R^{34}$, and $R^{35}$ independently represents a hydrogen atom or a substituent, and $A^1$ and $A^2$ have the same meaning as general formula (R-I).

General formula (R-III) will be explained in detail below.

$R^{31}$ represents a hydrogen atom or a substituent. When it is a substituent, an alkyl group, an aryl group, an acyl group, an alkoxy group, an aryloxy group, an alkylamino group, an arylamino group, an alkylaminocarbonyl group, an arylaminocarbonyl group, an alkoxycarbonyl group, and an aryloxycarbonyl group are preferable, and an alkyl group, an aryl group and an acyl group are preferable in particular.

Each of $R^{32}$, $R^{33}$, $R^{34}$, $R^{35}$ and $R^{36}$ represents a hydrogen atom or a substituent, and as examples of the substituent, a group previously mentioned as a substituent in $R^2$ of general formula (I) is mentioned. A halogen atom, an alkyl group, an aryl group, an acyl group, an acylamino group, an acyloxy group, an amino group, an anilino group, a sulfonylamino group, an aminocarbonylamino group, an alkoxy group, an aryloxy group, a carboxyl group, a hydroxyl group, an alkylthio group, an arylthio group, an aminocarbonyloxy group, and an aminosulfonyl group are preferable, and an alkyl group, an aryl group, an alkoxy group, an aryloxy group, a carboxyl group, a hydroxyl group and an acylamino group are more preferable. The substituents which were previously mentioned as specific examples in $R^1$ of general formula (I) are mentioned as the specific examples of these substituents.

The specific examples represented by general formula (R-I) ((R-I) to (R-38)) are mentioned below, but the present invention is not limited to these specific examples.

(R-1)

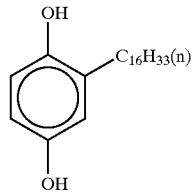

(R-2)

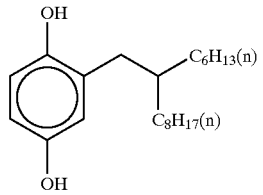

(R-3)

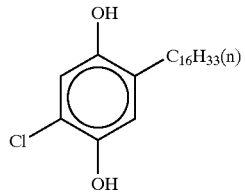

(R-4)

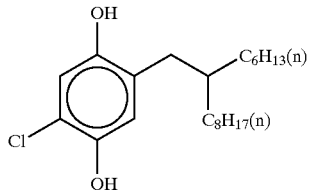

-continued
(R-5)
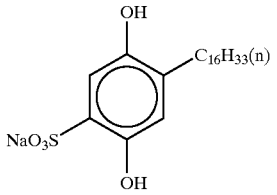
(R-6)
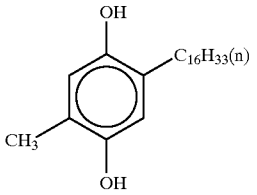
(R-7)
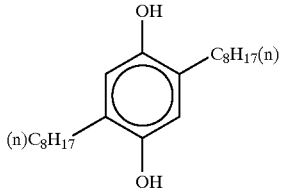
(R-8)
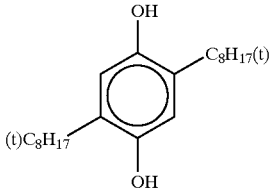
(R-9)
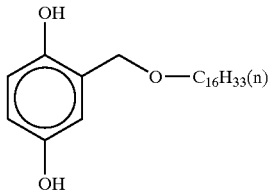
(R-10)
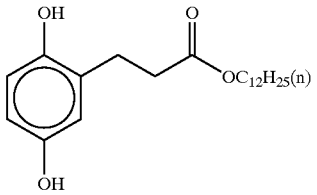
(R-11)
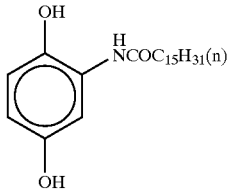
(R-12)
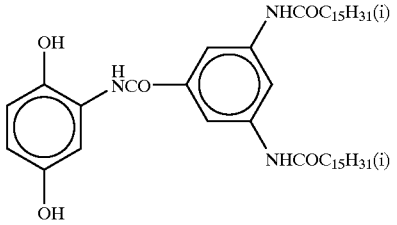
(R-13)
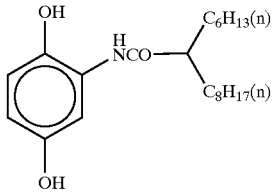
(R-14)
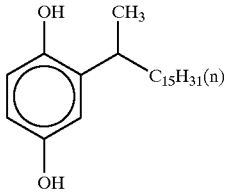
(R-15)
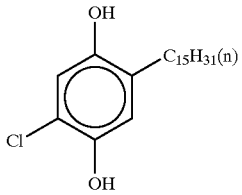
(R-16)
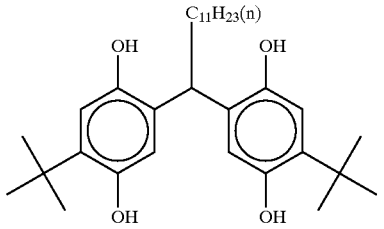
(R-17)
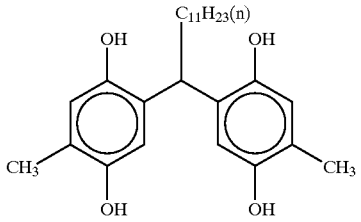
(R-18)
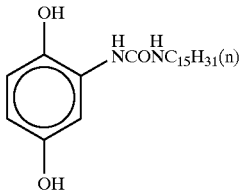

-continued
(R-19)
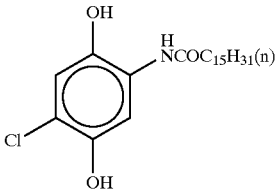
(R-20)
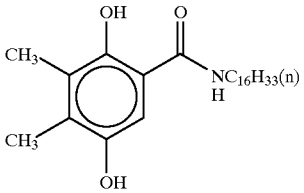
(R-21)
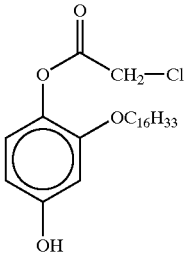
(R-22)
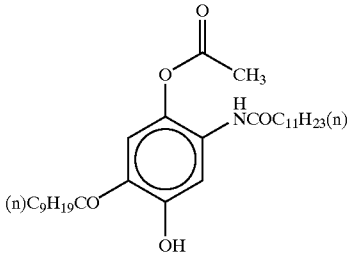
(R-23)
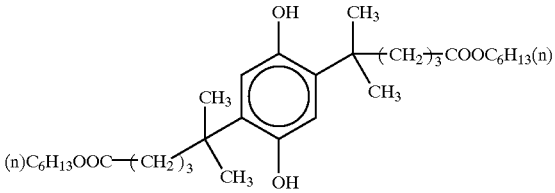
(R-24)
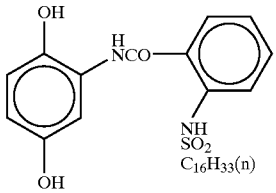
(R-25)
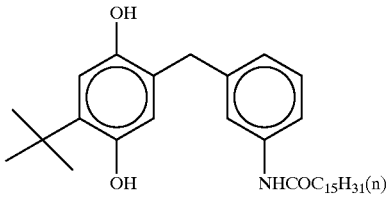
(R-26)
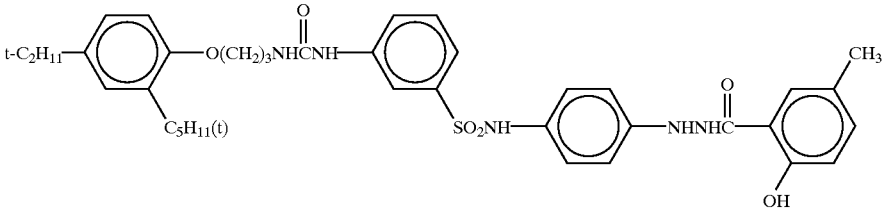
(R-27)
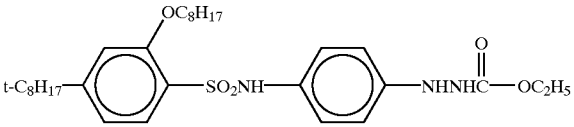
(R-28)
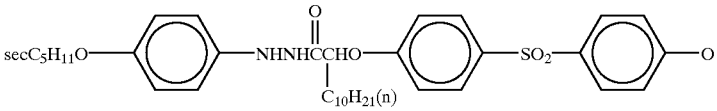
(R-29)
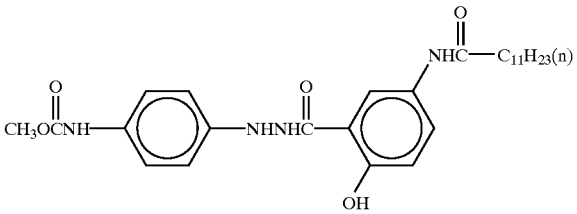

-continued (R-30)

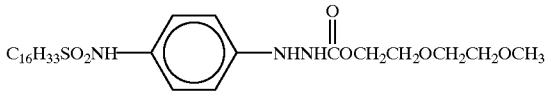

(R-31)

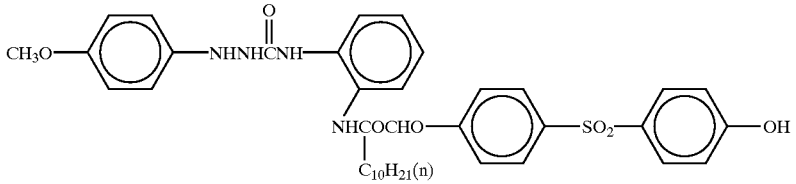

(R-32)

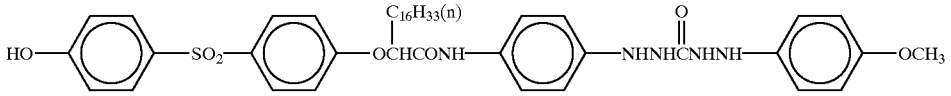

(R-33)

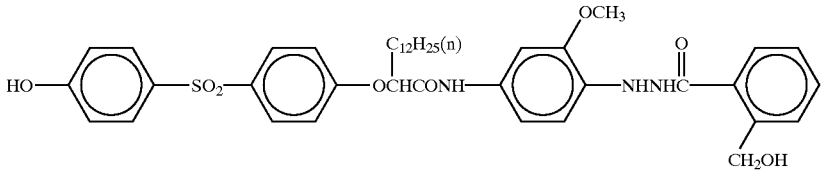

(R-34)

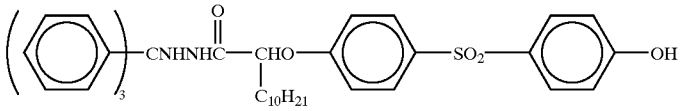

(R-35)

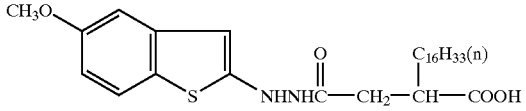

(R-36)

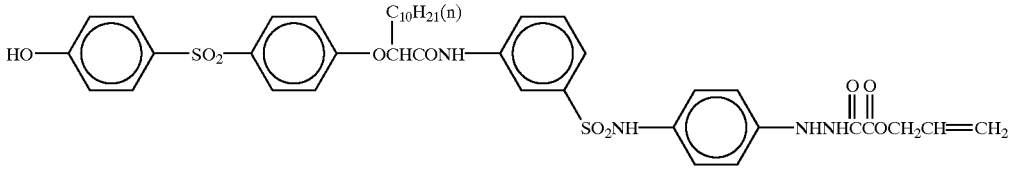

(R-37)

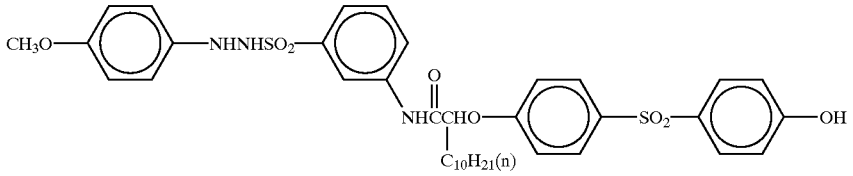

(R-38)

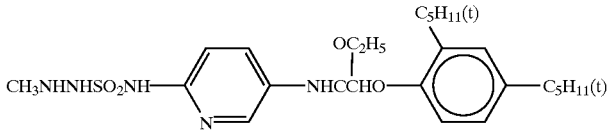

It is enough that the lightsensitive material of the present invention has respectively at least one layer of a blue-sensitive emulsion layer containing a yellow coupler, a green-sensitive emulsion layer containing a magenta coupler and a red-sensitive emulsion layer containing a cyan coupler, but it is preferable that each of the lightsensitive layers has a unit constitution which comprises 2 or more of lightsensitive emulsion layers having different sensitivity, and each of the lightsensitive layers comprises more preferably 3 or more of lightsensitive emulsion layers. It is preferable that non coloring interlayer is provided by coating between the lightsensitive emulsion layers having different color-sensitive property, and it is further preferable that the interlayer comprises 2 layers or more of non coloring layer, and colloid silver grains or silver halide grains whose surface or inside was preliminarily fogged are contained in non-lightsensitive layer which is directly brought in contact with the lowest sensitivity emulsion layer in a color-sensitive unit.

As one of the preferable embodiment of the present invention, there can be mentioned as an example, a mode in which the compound of general formula (I) and the reductive compound of general formula (R-I) are added in any one of, or a plural number of layers of (i) an antihalation layer, (ii) a first interlayer, (iii) a second interlayer, (iv) a third interlayer, (v) an yellow filter layer and '(vi) a first protective layer; in a lightsensitive element in which the respective layers are coated, on a support, in order of the antihalation layer/the first interlayer/the red-sensitive emulsion layer unit (comprising 3 layers of a low-speed red-sensitive layer/a medium-speed red-sensitive layer/a high-speed red-sensitive layer from the near side of the support)/the second interlayer/the green-sensitive emulsion layer unit (comprising 3 layers of a low-speed green-sensitive layer/a medium-speed green-sensitive layer/a high-speed green-sensitive layer from the near side of the support)/the third interlayer/the yellow filter layer/the blue-sensitive emulsion layer unit (comprising 3 layers of a low-speed blue-sensitive layer/a medium-speed blue-sensitive layer/a high-speed blue-sensitive layer from the near side of the support)/the first protective layer/the second protective layer.

In the present invention, when the silver halide amount of the color-sensitive unit which is closest to a support among the respective lightsensitive emulsion unit is more than 1.3 g (more preferably, more than 1.4 g), the accelerating effect of desilverization property by addition of the compound of the present invention is remarkably revealed.

Further, in the present invention, when the silver halide grains of the lightsensitive unit which is closest to a support are tabular grains, the effect is greatly revealed.

A value obtained by dividing the equivalent-circle diameter of the projected area of emulsion grain by the thickness of grain is called as an aspect ratio, and thus, the shape of tabular grains is specified. The tabular grains can be prepared by methods described in Cleave, "Photography Theory and Practice (1930), page 131"; Gutoff, "Photographic Science and Engineering, Vol. 14, pages 248–257 (1970)"; U.S. Pat. Nos. 4,434,226, 4,414,310, 4,433,048, and 4,439,520, GB No. 2,112,157 and the like. When the tabular grains are used, there are advantages that coating force is enhanced and the color sensitization efficiency by a sensitizing dye is raised, and they are described in detail in U.S. Pat. No. 4,434,226 which was previously cited.

In the present invention, the average aspect ratio of 80% or more of the total projected area of grains is preferably 1 or more and less than 100, more preferably 2 or more and less than 20, and preferably 3 or more and less than 10 in particular. As the shape of the tabular grains, triangle, hexagon, circle and the like can be selected. An equilateral hexagon whose six sides have about equal length as described in U.S. Pat. No. 4,797,354 is a preferable mode.

The equivalent-circle diameter of the projected area is often used as the grain size of the tabular grains, and grains having an average diameter of 0.6 $\mu$m or less as described in U.S. Pat. No. 4,748,106 is preferable for high quality image. Further, it is preferable for enhancing sharpness that the thickness of grain is limited to 0.5 $\mu$m or less and more preferably 0.3 $\mu$m or less as the shape of the tabular grains. Grains in which the thickness of grain and the inter-plane distance of twin crystal are specified and described in JP-A-63-163451 is a preferable mode.

Further, when tabular grains having monodisperse in which grain size distribution is narrow are used, a further preferable result is obtained. A method of producing a monodisperse hexagonal tabular grain having a high tabular ratio is described in U.S. Pat. No. 4,797,354 and JP-A-2-838. Further, a method of producing a tabular grain having the fluctuation coefficient of the grain size distribution which is less than 10% using a poly(alkylene oxide) block copolymer is described in EP No. 514,742. It is preferable to use these tabular grains for the present invention. Further, a grain with high uniformity having the fluctuation coefficient of the thickness of grain which is 30% or less is also preferable.

In the present invention, it is preferable that 50% or more (preferably, 70% or more) of silver halide converted to silver amount among the silver halide of a color-sensitive unit (preferably, a red-sensitive unit) which is closest to a support is a tabular grain having an aspect ratio of 3.0 or more.

Further, the effect of the present invention is remarkably revealed when the film thickness of an emulsion layer is comparatively large. Specifically, when the thickness at drying the whole of hydrophilic colloid layers (adjusted to a humidity of 55%) which were coated on the emulsion face side based on a support is 22 $\mu$m or more, and 24 $\mu$m or more in particular, it is effective.

Any development processing may be carried out for the lightsensitive material of the present invention, but the object of the present invention is an application to a color reversal film in which after black and white development is carried out, reverse processing is carried out, and color development is carried out in the presence of an aromatic primary amine color developer, and in this case, a desirable effect is obtained according to the present invention.

In particular, when the pH of a processing liquid of the first development being the black and white development is less than 10 (more preferably, less than 9.8) and the pH of a processing liquid of the color development is 11.5 or more (more preferably, 11.7 or more), it is preferable in particular because the effect of the present invention is remarkable.

With respect to the silver halide photographic emulsion of the present invention, and various techniques and inorganic/organic materials which can be used for the silver halide photographic lightsensitive material using thereof, those described in "Research Disclosure" No. 308119 (1989) and RD No. 37038 (1995) can be usually used.

In addition to this, more specifically, for example, various techniques and inorganic/organic materials which can be used for the silver halide photographic lightsensitive material to which the silver halide photographic emulsion of the present invention can be adopted, are described in the under-mentioned spot of EP No. 436,938A2 and the cited patents described below.

| | Items | Corresponding portions |
|---|---|---|
| 1) | Layer configurations | page 146, line 34 to page 147, line 25 |
| 2) | Silver halide emulsions usable together | page 147, line 26 to page 148 line 12 |
| 3) | Yellow couplers | page 137, line 35 to page 146, line 33, and page 149, lines 21 to 23 |
| 4) | Magenta couplers | page 149, lines 24 to 28; EP421, 453A1, page 3, line 5 to page 25, line 55 |
| 5) | Cyan couplers | page 149, lines 29 to 33; EP432, 804A2, page 3, line 28 to page 40, line 2 |
| 6) | Polymer couplers | page 149, lines 34 to 38; EP435, 334A2, page 113, line 39 to page 123, line 37 |

-continued

| | Items | Corresponding portions |
|---|---|---|
| 7) | Colored couplers | page 53, line 42 to page 137, line 34, and page 149, lines 39 to 45 |
| 8) | Functional couplers | page 7, line 1 to page 53, line 41, and page 149, line 46 to page 150, line 3; EP435, 334A2, page 3, line 1 to page 29, line 50 |
| 9) | Antiseptic and mildewproofing agents | page 150, lines 25 to 28 |
| 10) | Formal in scavengers | page 149, lines 15 to 17 |
| 11) | Other additives usable together | page 153, lines 38 to 47; EP421, 453A1, page 75, line 21 to page 84, line 56, and page 27, line 40 to page 37, line 40 |
| 12) | Dispersion methods | page 150, lines 4 to 24 |
| 13) | Supports | page 150, lines 32 to 34 |
| 14) | Film thickness · film physical properties | page 150, lines 35 to 49 |
| 15) | Color development step | page 150, line 50 to page 151, line 47 |
| 16) | Desilvering step | page 151, line 48 to page 152, line 53 |
| 17) | Automatic processor | page 152, line 54 to page 153, line 2 |
| 18) | Washing · stabilizing step | page 153, lines 3 to 37 |

EXAMPLE-1

The present invention will be described in detail below by way of its examples. However, the present invention is not limited to these examples. Formation of sample 101.

(i) Formation of Triacetyl Cellulose Films (Supports)

Triacetyl cellulose was dissolved (13% as a mass) in dichloromethane/methanol=92/8 (mass ratio) by normal solvent casting, and triphenyl phosphate and biphenyldiphenyl phosphate as plasticizers were added at a mass ratio of 2:1 such that the total amount was 14% with respect to the triacetyl cellulose, thereby forming a film by a band method. The thickness of support after drying was 97 μm.

(ii) Contents of Undercoat Layer

The two surfaces of each above triacetyl cellulose films were coated with an undercoat solution having the following composition. Each number represents a mass contained per liter of the undercoat solution.

Before this undercoating was performed, the two surfaces of each film were subjected to a corona discharge treatment.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water to make | 1.0 L |

(iii) Coating of Back Layers one surface of the support undercoated with an undercoat solution was coated with back layers described below.

| | |
|---|---|
| 1st layer Binder: | |
| acid-processed gelatin (isoelectric point 9.0) | 1.00 g |
| Polymer latex: P-2 (average grain size 0.1 μm) | 0.13 g |
| Polymer latex: P-3 (average grain size 0.2 μm) | 0.23 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| 2nd layer Binder: | |
| acid-processed gelatin (isoelectric point 9.0) | 3.10 g |
| Polymer latex: P-3 (average grain size 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| 3rd layer Binder: | |
| acid-processed gelatin (isoelectric point 9.0) | 3.30 g |
| Surfactant W-3 | 0.020 g |
| Potassium sulfate | 0.30 g |
| Sodium hydroxide | 0.03 g |
| 4th layer Binder: | |
| lime-processed gelatin | 1.15 g |
| 1:9 copolymer of methacrylic acid and methylmethacrylate (average grain size 2.0 μm) | 0.040 g |
| 6:4 copolymer of methacrylic acid and methylmethacrylate (average grain size 2.0 μm) | 0.030 g |
| Surfactant W-3 | 0.060 g |
| Surfactant W-2 | 7.0 mg |
| Hardener H-1 | 0.23 g |

(iv) Coating of Lightsensitive Emulsion Layers

The lightsensitive emulsion layers shown below were coated on the reverse side to which a back layer was coated to make sample 101. The number represents an addition amount per $m^2$. Further, the effect of the compound added is not limited to the use described.

| | |
|---|---|
| 1st layer: Antihalation layer | |
| Black colloidal silver | 0.25 g |
| Gelatin | 2.40 g |
| Ultraviolet absorbent U-1 | 0.15 g |
| Ultraviolet absorbent U-3 | 0.15 g |
| Ultraviolet absorbent U-4 | 0.10 g |
| Ultraviolet absorbent U-5 | 0.10 g |
| High-boiling organic solvent Oil-1 | 0.10 g |
| High-boiling organic solvent Oil-2 | 0.10 g |
| High-boiling organic solvent Oil-5 | 0.010 g |
| Dye D-4 | 1.0 mg |

-continued

| | | |
|---|---|---|
| Dye D-8 | | 2.5 mg |
| Fine-crystal solid dispersion of dye E-1 | | 0.05 g |

2nd layer: Interlayer

| | | |
|---|---|---|
| Gelatin | | 0.50 g |
| Compound Cpd-A | | 0.2 mg |
| Compound Cpd-K | | 3.0 mg |
| Compound Cpd-M | | 0.030 g |
| Ultraviolet absorbent U-6 | | 6.0 mg |
| High-boiling organic solvent Oil-3 | | 0.010 g |
| High-boiling organic solvent Oil-4 | | 0.010 g |
| High-boiling organic solvent Oil-7 | | 2.0 mg |
| Dye D-7 | | 4.0 mg |

3rd layer: Interlayer

| | | |
|---|---|---|
| Yellow colloidal silver | silver | 0.020 g |
| Silver iodobromide emulsion whose surface and internal thereof are fogged in advance. (cubic, average silver iodide content 1%, average equivalent-sphere diameter 0.06 μm) | silver | 0.010 g |
| Gelatin | | 0.60 g |
| Compound Cpd-D | | 0.020 g |
| High-boiling organic solvent Oil-3 | | 0.010 g |
| High-boiling organic solvent Oil-8 | | 0.010 g |

4th layer: Low-speed red-sensitive emulsion layer

| | | |
|---|---|---|
| Emulsion A | silver | 0.10 g |
| Emulsion B | silver | 0.15 g |
| Emulsion C | silver | 0.15 g |
| Gelatin | | 0.80 g |
| Coupler C-1 | | 0.15 g |
| Coupler C-2 | | 7.0 mg |
| Coupler C-10 | | 3.0 mg |
| Coupler C-11 | | 2.0 mg |
| Ultraviolet absorbent U-3 | | 0.010 g |
| Compound Cpd-I | | 0.020 g |
| Compound Cpd-D | | 3.0 mg |
| Compound Cpd-J | | 2.0 mg |
| High-boiling organic solvent Oil-10 | | 0.030 g |
| Additive P-1 | | 5.0 mg |

5th layer: Medium-speed red-sensitive emulsion layer

| | | |
|---|---|---|
| Emulsion C | silver | 0.15 g |
| Emulsion D | silver | 0.15 g |
| Gelatin | | 0.70 g |
| Coupler C-1 | | 0.15 g |
| Coupler C-2 | | 7.0 mg |
| Coupler C-10 | | 3.0 mg |
| Compound Cpd-D | | 3.0 mg |
| Ultraviolet absorbent U-3 | | 0.010 g |
| High-boiling organic solvent Oil-10 | | 0.030 g |
| Additive P-1 | | 7.0 mg |

6th layer: High-speed red-sensitive emulsion layer

| | | |
|---|---|---|
| Emulsion E | silver | 0.15 g |
| Emulsion F | silver | 0.20 g |
| Gelatin | | 1.50 g |
| Coupler C-1 | | 0.60 g |
| Coupler C-2 | | 0.015 g |
| Coupler C-3 | | 0.030 g |
| Coupler C-10 | | 5.0 mg |
| Ultraviolet absorbent U-1 | | 0.010 g |
| Ultraviolet absorbent U-2 | | 0.010 g |
| High-boiling organic solvent Oil-6 | | 0.030 g |
| High-boiling organic solvent Oil-9 | | 0.020 g |
| High-boiling organic solvent Oil-10 | | 0.050 g |
| Compound Cpd-D | | 5.0 mg |
| Compound Cpd-K | | 1.0 mg |
| Compound Cpd-F | | 0.030 g |
| Compound Cpd-L | | 1.0 mg |
| Additive P-1 | | 0.10 g |
| Additive P-4 | | 0.030 g |

7th layer: Interlayer

| | | |
|---|---|---|
| Gelatin | | 0.70 g |
| Additive P-2 | | 0.10 g |
| Dye D-5 | | 0.020 g |
| Dye D-9 | | 6.0 mg |

-continued

| | | |
|---|---|---|
| Compound Cpd-I | | 0.010 g |
| Compound Cpd-M | | 0.040 g |
| Compound Cpd-O | | 3.0 mg |
| Compound Cpd-P | | 5.0 mg |
| High-boiling organic solvent Oil-6 | | 0.050 g |

8th layer: Interlayer

| | | |
|---|---|---|
| Yellow colloidal silver | silver | 0.020 g |
| Gelatin | | 1.00 g |
| Additive P-2 | | 0.05 g |
| Ultraviolet absorbent U-1 | | 0.010 g |
| Ultraviolet absorbent U-3 | | 0.010 g |
| Compound Cpd-A | | 0.050 g |
| Compound Cpd-D | | 0.030 g |
| Compound Cpd-M | | 0.050 g |
| High-boiling organic solvent Oil-3 | | 0.010 g |
| High-boiling organic solvent Oil-6 | | 0.050 g |

9th layer: Low-speed green-sensitive emulsion layer

| | | |
|---|---|---|
| Emulsion G | silver | 0.25 g |
| Emulsion H | silver | 0.30 g |
| Emulsion I | silver | 0.25 g |
| Gelatin | | 1.30 g |
| Coupler C-4 | | 0.20 g |
| Coupler C-5 | | 0.050 g |
| Coupler C-6 | | 0.020 g |
| Compound Cpd-A | | 5.0 mg |
| Compound Cpd-B | | 0.030 g |
| Compound Cpd-D | | 5.0 mg |
| Compound Cpd-G | | 2.5 mg |
| Compound Cpd-F | | 0.010 g |
| Compound Cpd-K | | 2.0 mg |
| Ultraviolet absorbent U-6 | | 5.0 mg |
| High-boiling organic solvent Oil-2 | | 0.25 g |
| Additive P-1 | | 5.0 mg |

10th layer: Medium-speed green-sensitive emulsion layer

| | | |
|---|---|---|
| Emulsion I | silver | 0.30 g |
| Emulsion J | silver | 0.30 g |
| Internally fogged silver bromide emulsion (cubic, average equivalent-sphere diameter 0.11 μm) | silver | 3.0 mg |
| Gelatin | | 0.70 g |
| Coupler C-4 | | 0.25 g |
| Coupler C-5 | | 0.050 g |
| Coupler C-6 | | 0.020 g |
| Compound Cpd-A | | 5.0 mg |
| Compound Cpd-B | | 0.030 g |
| Compound Cpd-F | | 0.010 g |
| Compound Cpd-G | | 2.0 mg |
| High-boiling organic solvent Oil-2 | | 0.20 g |
| High-boiling organic solvent Oil-9 | | 0.050 g |

11th layer: High-speed green-sensitive emulsion layer

| | | |
|---|---|---|
| Emulsion K | silver | 0.40 g |
| Gelatin | | 0.80 g |
| Coupler C-4 | | 0.30 g |
| Coupler C-5 | | 0.080 g |
| Coupler C-7 | | 0.050 g |
| Compound Cpd-A | | 5.0 mg |
| Compound Cpd-B | | 0.030 g |
| Compound Cpd-F | | 0.010 g |
| High-boiling organic solvent Oil-2 | | 0.20 g |
| High-boiling organic solvent Oil-9 | | 0.050 g |

12th layer: Yellow filter layer

| | | |
|---|---|---|
| Yellow colloidal silver | silver | 0.010 g |
| Gelatin | | 1.00 g |
| Compound Cpd-C | | 0.010 g |
| Compound Cpd-M | | 0.10 g |
| High-boiling organic solvent Oil-1 | | 0.020 g |
| High-boiling organic solvent Oil-6 | | 0.10 g |
| Fine-crystal solid dispersion of dye E-2 | | 0.20 g |

13th layer: Interlayer

| | | |
|---|---|---|
| Gelatin | | 0.40 g |
| Compound Cpd-Q | | 0.20 g |
| Dye D-6 | | 2.5 mg |

-continued

14th layer: Low-speed blue-sensitive emulsion layer

| | | |
|---|---|---|
| Emulsion L | silver | 0.15 g |
| Emulsion M | silver | 0.20 g |
| Emulsion N | silver | 0.10 g |
| Gelatin | | 0.80 g |
| Coupler C-8 | | 0.020 g |
| Coupler C-9 | | 0.30 g |
| Coupler C-10 | | 5.0 mg |
| Compound Cpd-B | | 0.10 g |
| Compound Cpd-I | | 8.0 mg |
| Compound Cpd-K | | 1.0 mg |
| Compound Cpd-M | | 0.010 g |
| Ultraviolet absorbent U-6 | | 0.010 g |
| High-boiling organic solvent Oil-2 | | 0.010 g |

15th layer: Medium-speed blue-sensitive emulsion layer

| | | |
|---|---|---|
| Emulsion N | silver | 0.20 g |
| Emulsion O | silver | 0.20 g |
| Internally fogged silver bromide emulsion (cubic, average equivalent-sphere grain size 0.11 μm) | silver | 3.0 mg |
| Gelatin | | 0.80 g |
| Coupler C-8 | | 0.020 g |
| Coupler C-9 | | 0.25 g |
| Coupler C-10 | | 0.25 g |
| Compound Cpd-B | | 0.010 g |
| Compound Cpd-N | | 2.0 mg |
| High-boiling organic solvent Oil-2 | | 0.010 g |

16th layer: High-speed blue-sensitive emulsion layer

| | | |
|---|---|---|
| Emulsion P | silver | 0.20 g |
| Emulsion Q | silver | 0.25 g |
| Gelatin | | 2.00 g |
| Coupler C-3 | | 5.0 mg |
| Coupler C-8 | | 0.10 g |
| Coupler C-9 | | 1.00 g |
| Coupler C-10 | | 0.020 g |
| High-boiling organic solvent Oil-2 | | 0.10 g |
| High-boiling organic solvent Oil-3 | | 0.020 g |
| Ultraviolet absorbent U-6 | | 0.10 g |
| Compound Cpd-B | | 0.20 g |
| Compound Cpd-N | | 5.0 mg |

-continued

17th layer: 1st protective layer

| | | |
|---|---|---|
| Gelatin | | 1.00 g |
| Ultraviolet absorbent U-1 | | 0.15 g |
| Ultraviolet absorbent U-2 | | 0.050 g |
| Ultraviolet absorbent U-5 | | 0.20 g |
| Compound Cpd-O | | 5.0 mg |
| Compound Cpd-A | | 0.030 g |
| Compound Cpd-E | | 0.10 g |
| Compound Cpd-H | | 0.20 g |
| Dye D-1 | | 8.0 mg |
| Dye D-2 | | 0.010 g |
| Dye D-3 | | 0.010 g |
| High-boiling organic solvent Oil-3 | | 0.10 g |

18th layer: 2nd protective layer

| | | |
|---|---|---|
| Colloidal silver | silver | 2.5 mg |
| Fine-grain silver iodobromide emulsion (average grain size 0.06 μm, AgI content 1 mol %) | silver | 0.10 g |
| Gelatin | | 0.80 g |
| Ultraviolet absorbent U-1 | | 0.030 g |
| Ultraviolet absorbent U-6 | | 0.030 g |
| High-boiling organic solvent Oil-3 | | 0.010 g |

19th layer: 3rd protective layer

| | | |
|---|---|---|
| Gelatin | | 1.00 g |
| Polymethylmethacrylate (average grain size 1.5 μm) | | 0.10 g |
| 6:4 copolymer of methylmethacrylate and methacrylic acid (average grain size 1.5 μm) | | 0.15 g |
| Silicone oil SO-1 | | 0.20 g |
| Surfactant W-1 | | 3.0 mg |
| Surfactant W-2 | | 8.0 mg |
| Surfactant W-3 | | 0.040 g |
| Surfactant W-7 | | 0.015 g |

In addition to the above compositions, additives F-1 to F-9 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

The light-sensitive emulsions used in sample 101 are shown in tables 1 to 5.

TABLE 1

Silver bromoiodide emulsions used in Sample 101

| Emulsion | Characteristics | Average equivalent-sphere diameter (μm) | Variation coefficient (%) | Average AgI content (%) | Halogen composition structure of silver halide grain | AgI content of grain surface (%) | Other characteristics ① | ② | ③ | ④ | ⑤ |
|---|---|---|---|---|---|---|---|---|---|---|---|
| A | Monodisperse tetradecahedral grain | 0.24 | 9 | 3.5 | Triple | 1.5 | | ○ | | | |
| B | Monodisperse (111) tabular grain Average aspect ratio 2.0 | 0.25 | 10 | 3.5 | Quadruple | 1.5 | ○ | | ○ | ○ | ○ |
| C | Monodisperse (111) tabular grain Average aspect ratio 2.0 | 0.30 | 19 | 3.0 | Triple | 0.1 | ○ | ○ | | ○ | ○ |
| D | Monodisperse (111) tabular grain Average aspect ratio 3.0 | 0.35 | 21 | 4.8 | Triple | 2.0 | ○ | ○ | | ○ | ○ |
| E | Monodisperse (111) tabular grain Average aspect ratio 3.0 | 0.40 | 10 | 2.0 | Quadruple | 1.5 | ○ | | | | |
| F | Monodisperse (111) tabular grain Average aspect ratio 4.5 | 0.55 | 12 | 1.6 | Triple | 0.6 | ○ | ○ | | | ○ |

TABLE 1-continued

Silver bromoiodide emulsions used in Sample 101

| Emulsion | Characteristics | Average equivalent-sphere diameter (μm) | Variation coefficient (%) | Average AgI content (%) | Halogen composition structure of silver halide grain | AgI content of grain surface (%) | Other characteristics ① | ② | ③ | ④ | ⑤ |
|---|---|---|---|---|---|---|---|---|---|---|---|
| G | Monodisperse cubic grain | 0.15 | 9 | 3.5 | Quadruple | 2.0 | | | ○ | | |
| H | Monodisperse cubic grain | 0.24 | 12 | 4.9 | Quadruple | 0.1 | ○ | ○ | | ○ | |
| I | Monodisperse (111) tabular grain Average aspect ratio 4.0 | 0.30 | 12 | 3.5 | Quintuple | 4.5 | ○ | ○ | | ○ | ○ |
| J | Monodisperse (111) tabular grain Average aspect ratio 5.0 | 0.45 | 21 | 3.0 | Quadruple | 0.2 | ○ | ○ | | ○ | ○ |
| K | Monodisperse (111) tabular grain Average aspect ratio 5.5 | 0.60 | 13 | 2.7 | Triple | 1.3 | ○ | ○ | | | ○ |

TABLE 2

Silver bromoiodide emulsions used in Sample 101

| Emulsion | Characteristics | Average equivalent-sphere diameter (μm) | Variation coefficient (%) | Average AgI content (%) | Halogen composition structure of silver halide grain | AgI content of grain surface (%) | Other characteristics ① | ② | ③ | ④ | ⑤ |
|---|---|---|---|---|---|---|---|---|---|---|---|
| L | Monodisperse tetradecahedral grain | 0.31 | 9 | 7.5 | Triple | 7.0 | | | ○ | | ○ |
| M | Monodisperse tetradecahedral grain | 0.31 | 9 | 7.5 | Triple | 5.0 | ○ | ○ | | ○ | ○ |
| N | Monodisperse (111) tabular grain Average aspect ratio 3.0 | 0.33 | 13 | 2.1 | Quadruple | 4.0 | ○ | ○ | ○ | | |
| O | Monodisperse (111) tabular grain Average aspect ratio 3.0 | 0.43 | 9 | 2.5 | Quadruple | 1.0 | ○ | ○ | | | ○ |
| P | Monodisperse (111) tabular grain Average aspect ratio 6.0 | 0.75 | 21 | 2.8 | Triple | 0.5 | ○ | ○ | | | ○ |
| Q | Monodisperse (111) tabular grain Average aspect ratio 6.0 | 0.90 | 8 | 1.0 | Quadruple | 0.5 | ○ | ○ | | | ○ |

(Other characteristics)
① A reduction sensitizer was added during grain formation.
② A selenium sensitizer was used as an after-ripening chemical.
③ A rhodium salt was added during grain formation.
④ Subsequently after-ripening, 10% silver nitrate based on silver molar ratio to the emulsion grain at that time and its equimolar potassium bromide were added and the shell formation was carried out.
⑤ It was observed by a transmission electron microscope that 10 or more of dislocation lines per one grain exist in average.
Further, all of the lightsensitive emulsions were post-ripened using sodium thiosulfate, potassium thiocyanate and sodium chloroaurate.
Further, an iridium salt was appropriately added during grain formation.
Further, a chemically modified gelatin in which a portion of the amino group of gelatin was converted to phthalic amide was added to the emulsion B, C, E, H, J, N and Q

TABLE 3

Spectral sensitization of emulsions A to Q

| Emulsion | Added sensitizing dye | Addition amount (g) per mol of silver halide | Addition timing of sensitizing dye |
|---|---|---|---|
| A | S-1 | 0.01 | Subsequently to after-ripening |
| | S-2 | 0.35 | Prior to after-ripening |
| | S-3 | 0.02 | Prior to after-ripening |

TABLE 3-continued

Spectral sensitization of emulsions A to Q

| Emulsion | Added sensitizing dye | Addition amount (g) per mol of silver halide | Addition timing of sensitizing dye |
|---|---|---|---|
| | S-8 | 0.03 | Prior to after-ripening |
| | S-13 | 0.015 | Prior to after-ripening |
| | S-14 | 0.01 | Prior to after-ripening |
| B | S-2 | 0.35 | Prior to after-ripening |
| | S-3 | 0.02 | Prior to after-ripening |
| | S-8 | 0.03 | Prior to after-ripening |
| | S-13 | 0.015 | Prior to after-ripening |
| | S-14 | 0.01 | Prior to after-ripening |
| C | S-2 | 0.45 | Prior to after-ripening |
| | S-8 | 0.04 | Prior to after-ripening |
| | S-13 | 0.02 | Prior to after-ripening |
| D | S-2 | 0.5 | Subsequently to after-ripening |
| | S-3 | 0.05 | Subsequently to after-ripening |
| | S-8 | 0.05 | Prior to after-ripening |
| | S-13 | 0.015 | Prior to after-ripening |
| E | S-1 | 0.01 | Prior to after-ripening |
| | S-2 | 0.45 | Prior to after-ripening |
| | S-8 | 0.05 | Prior to after-ripening |
| | S-13 | 0.01 | Subsequently to after-ripening |

TABLE 4

Spectral sensitization of emulsions A to Q

| Emulsion | Added sensitizing dye | Addition amount (g) per mol of silver halide | Addition timing of sensitizing dye |
|---|---|---|---|
| F | S-2 | 0.4 | Prior to after-ripening |
| | S-3 | 0.04 | Prior to after-ripening |
| | S-8 | 0.04 | Prior to after-ripening |
| G | S-4 | 0.3 | Subsequently to after-ripening |
| | S-5 | 0.05 | Subsequently to after-ripening |
| | S-12 | 0.1 | Subsequently to after-ripening |
| H | S-4 | 0.2 | Prior to after-ripening |
| | S-5 | 0.05 | Subsequently to after-ripening |
| | S-9 | 0.15 | Prior to after-ripening |
| | S-14 | 0.02 | Subsequently to after-ripening |
| I | S-4 | 0.3 | Prior to after-ripening |
| | S-9 | 0.2 | Prior to after-ripening |
| | S-12 | 0.1 | Prior to after-ripening |
| J | S-4 | 0.35 | Prior to after-ripening |
| | S-5 | 0.05 | Subsequently to after-ripening |
| | S-12 | 0.1 | Prior to after-ripening |
| K | S-4 | 0.3 | Prior to after-ripening |
| | S-9 | 0.05 | Prior to after-ripening |
| | S-12 | 0.1 | Prior to after-ripening |
| | S-14 | 0.02 | Prior to after-ripening |
| L, M | S-6 | 0.1 | Subsequently to after-ripening |
| | S-10 | 0.2 | Subsequently to after-ripening |
| | S-11 | 0.05 | Subsequently to after-ripening |
| N | S-6 | 0.05 | Subsequently to after-ripening |
| | S-7 | 0.05 | Subsequently to after-ripening |
| | S-10 | 0.25 | Subsequently to after-ripening |
| | S-11 | 0.05 | Subsequently to after-ripening |

TABLE 5

Spectral sensitization of emulsions A to Q

| Emulsion | Added sensitizing dye | Addition amount (g) per mol of silver halide | Addition timing of sensitizing dye |
|---|---|---|---|
| O | S-10 | 0.4 | Subsequently to after-ripening |
| | S-11 | 0.15 | Subsequently to after-ripening |
| P | S-6 | 0.05 | Subsequently to after-ripening |
| | S-7 | 0.05 | Subsequently to after-ripening |
| | S-10 | 0.3 | Prior to after-ripening |
| | S-11 | 0.1 | Prior to after-ripening |

TABLE 5-continued

Spectral sensitization of emulsions A to Q

| Emulsion | Added sensitizing dye | Addition amount (g) per mol of silver halide | Addition timing of sensitizing dye |
|---|---|---|---|
| Q | S-6 | 0.05 | Prior to after-ripening |
| | S-7 | 0.05 | Prior to after-ripening |
| | S-10 | 0.2 | Prior to after-ripening |
| | S-11 | 0.25 | Prior to after-ripening |

Compounds used for formation of the respective layers of the sample 101 are shown below.

C-1

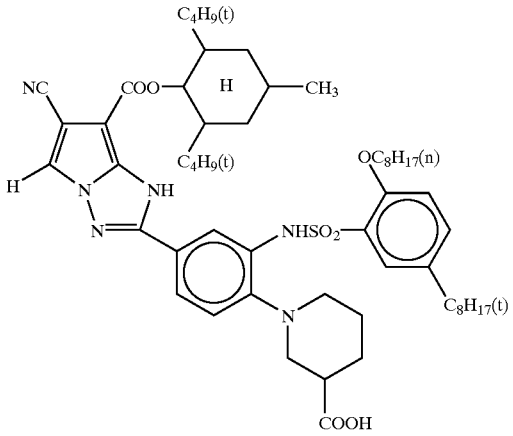

C-2

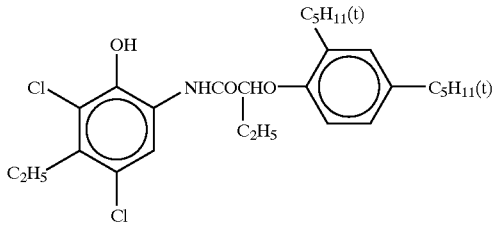

C-3

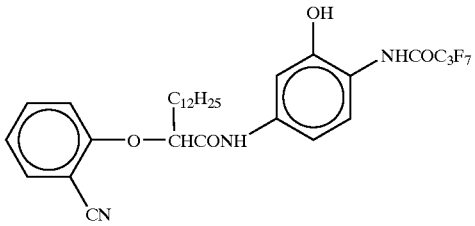

C-4

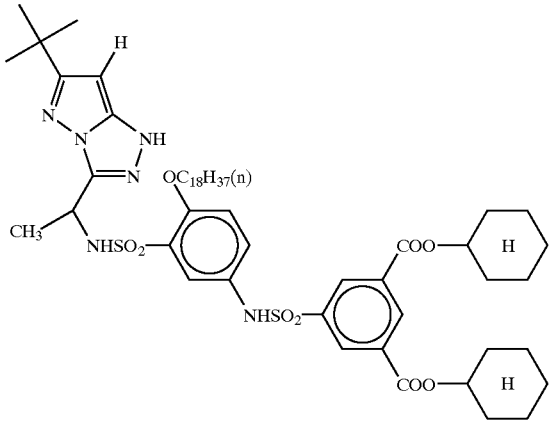

C-5

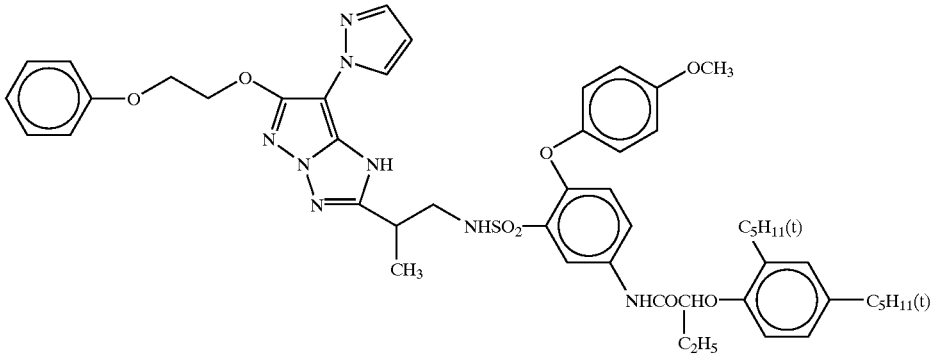

-continued
C-6
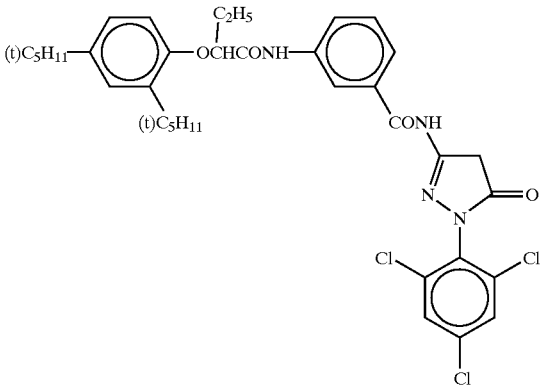
C-7
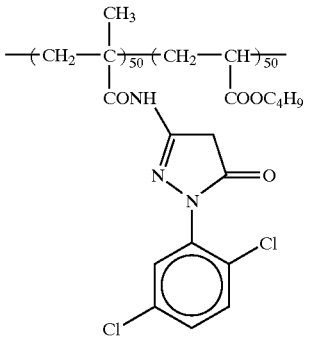
Numbers represent mass %
Average molecular weight: about 25,000
C-8
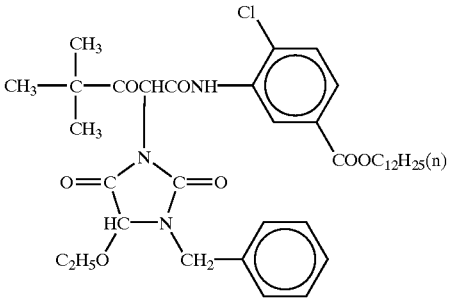
C-9
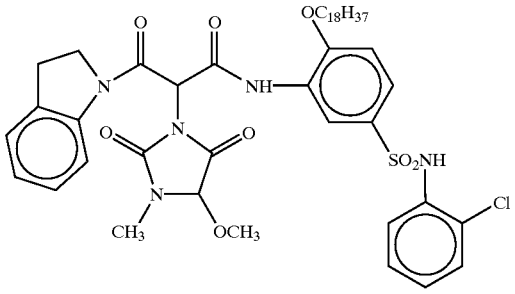
C-10
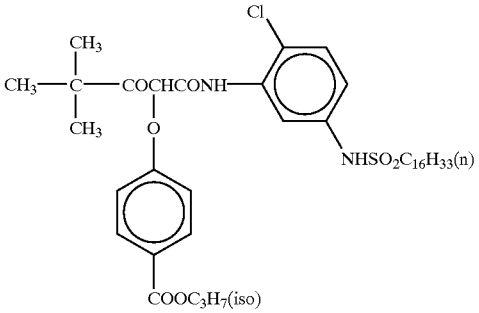
C-11
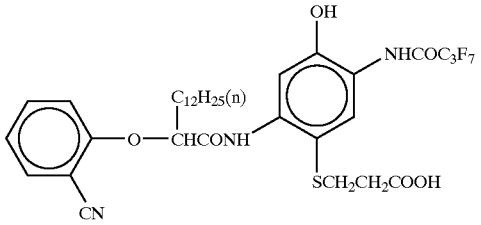
Oil-1
Tri-n-hexyl phosphate
Oil-2
Tricresyl phosphate
Oil-3
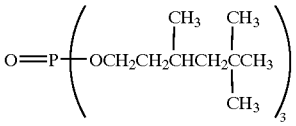
Bis(2-ethyl hexyl)succinate
Oil-4
Tricyclohexyl phosphate
Oil-5
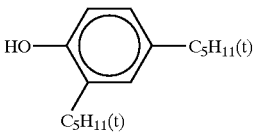
Oil-6
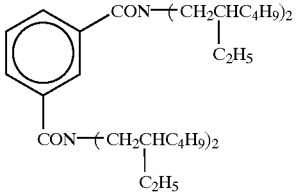
Oil-7
Oil-8
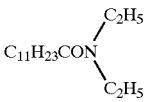

-continued
Oil-9
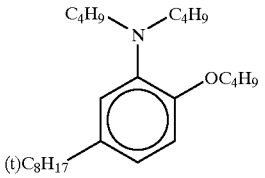
Oil-10
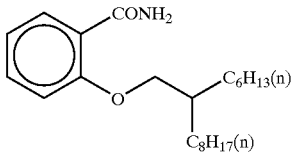
Cpd-A
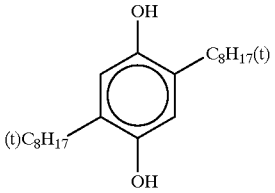
Cpd-B
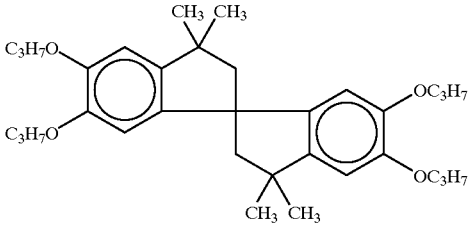
Cpd-C
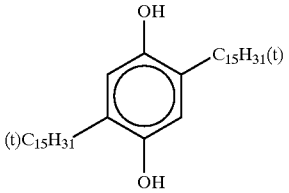
Cpd-D
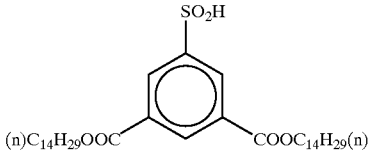
Cpd-E
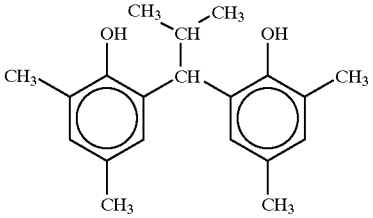
Cpd-F
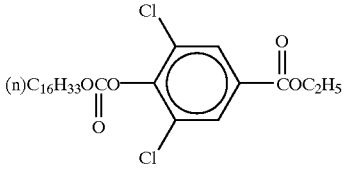
Cpd-G
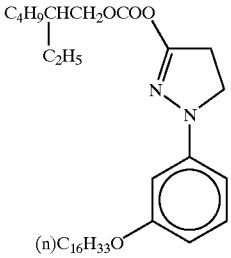
Cpd-H
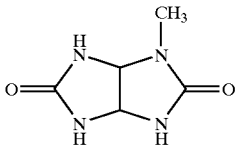
Cpd-I
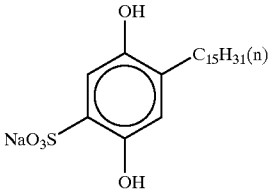
Cpd-J
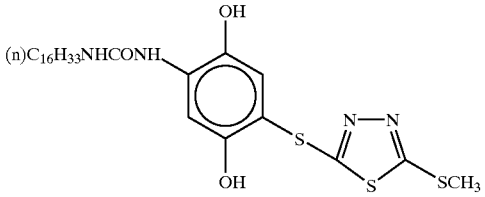
Cpd-K
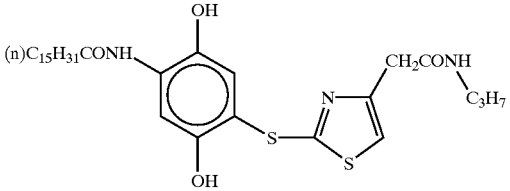
Cpd-L
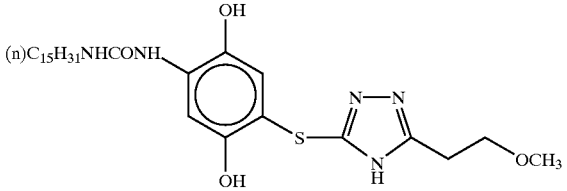

-continued
Cpd-M
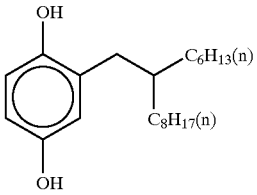
Cpd-N
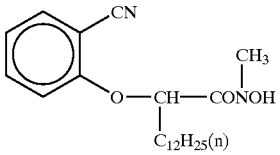
Cpd-O
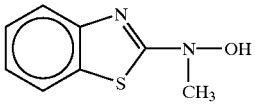
Cpd-P
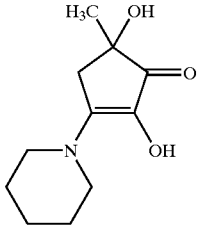
Cpd-Q
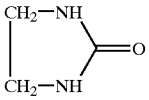
U-1
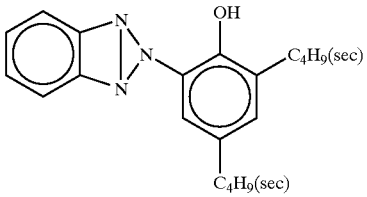
U-2
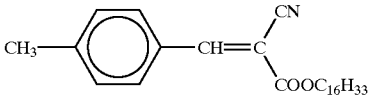
U-3
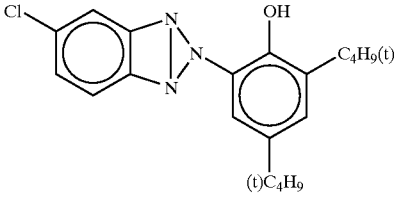
U-4
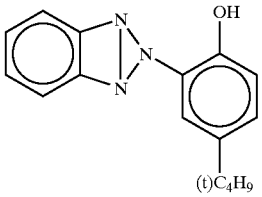
U-5
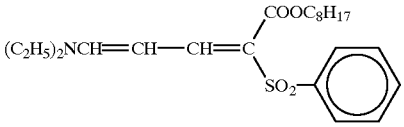
U-6
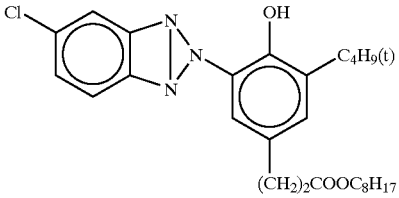
S-1
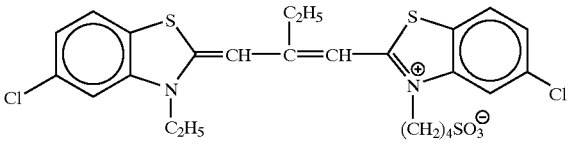
S-2
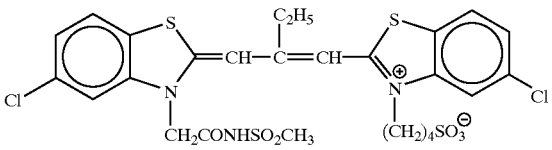
S-3
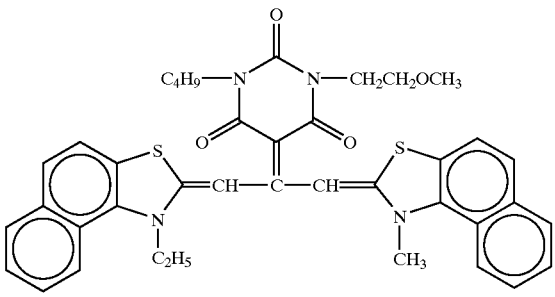

-continued
S-4
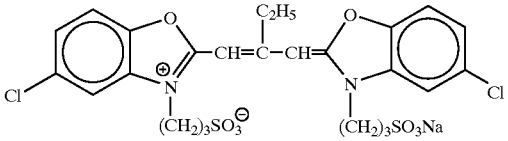
S-5
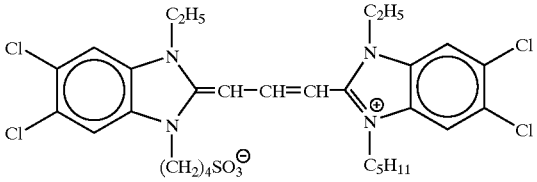
S-6
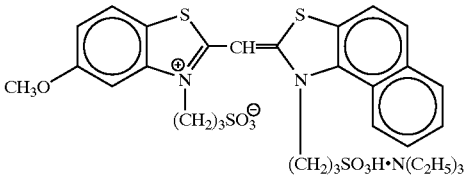
S-7
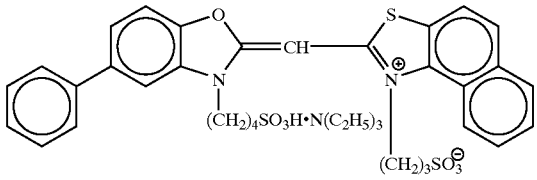
S-8
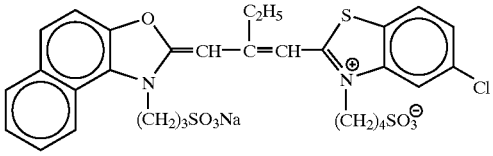
S-9
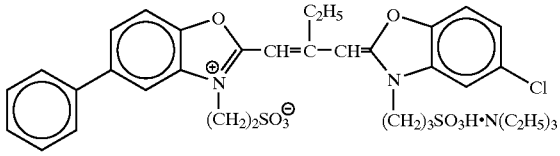
S-10
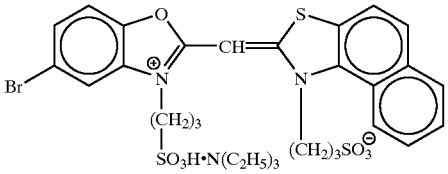
S-11
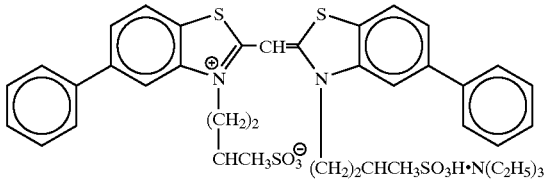
S-12
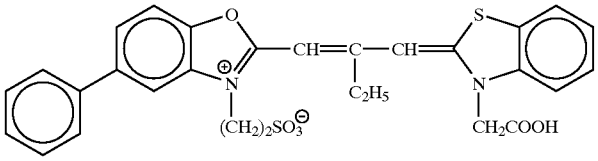
S-13
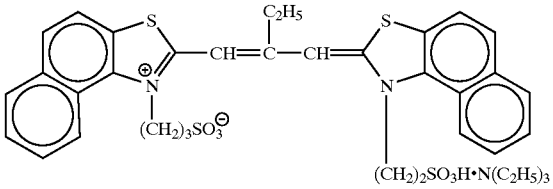
S-14
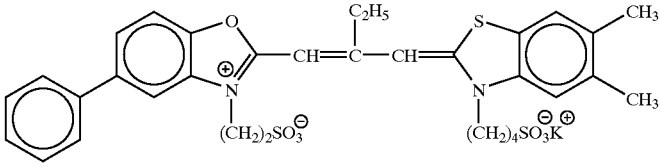
D-1
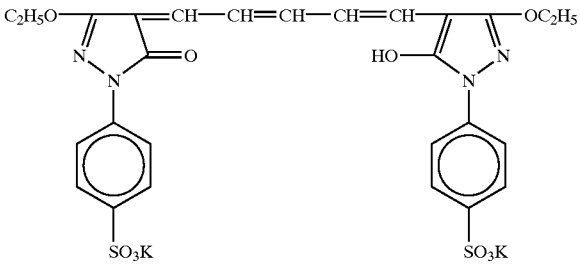

-continued
D-2
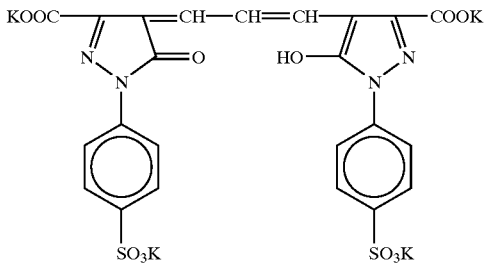
D-3
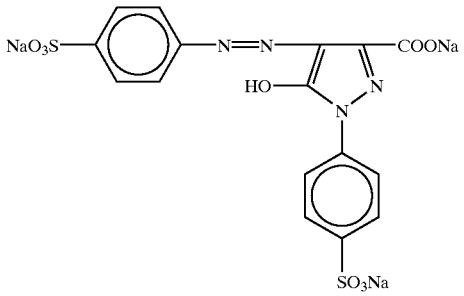
D-4
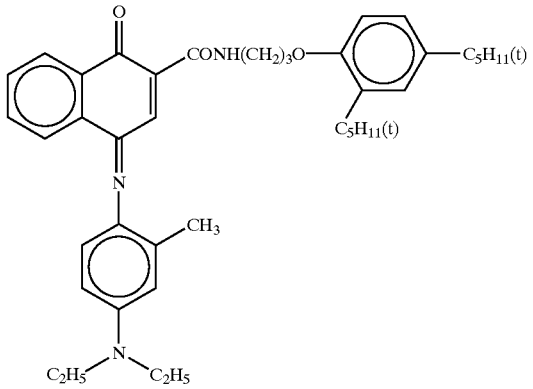
D-5
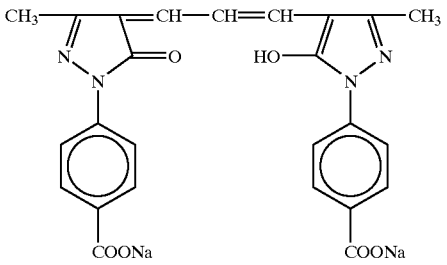
D-6
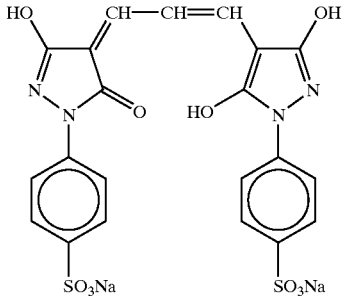
D-7
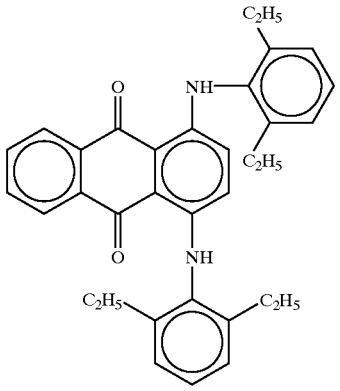

-continued
D-8
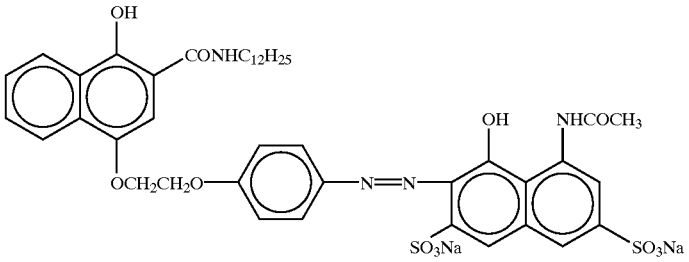
D-9
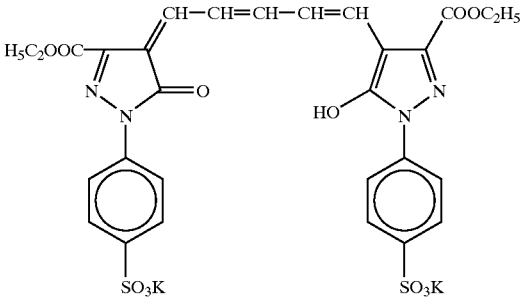
D-10
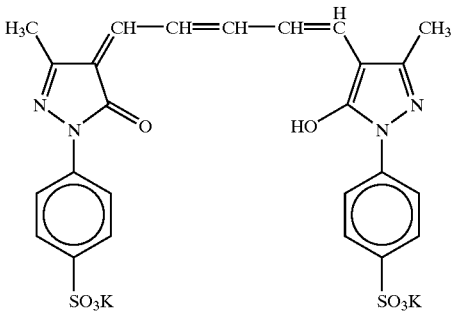
E-1
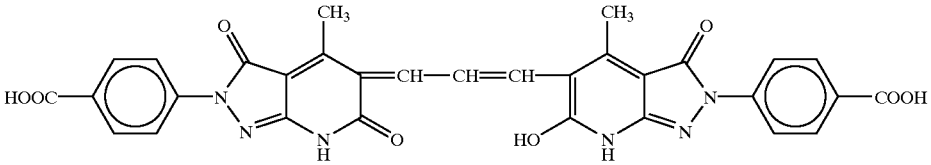
E-2
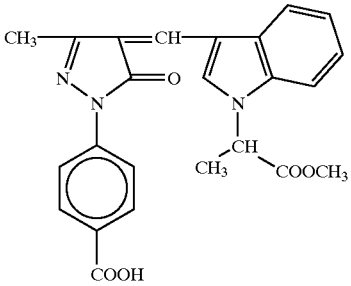
H-1
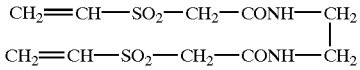
W-1
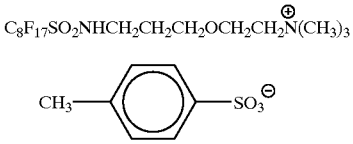
W-2
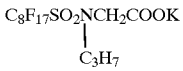
W-3
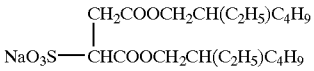
W-4
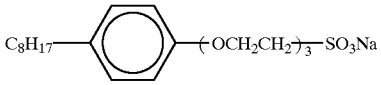
W-5
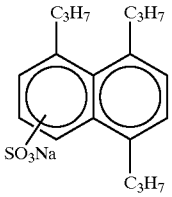
W-6
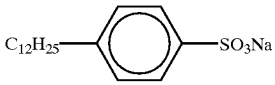
W-7
$C_8F_{17}SO_3Li$
P-1
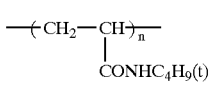
(n = 100 to 1000)

-continued
P-2
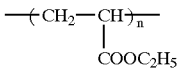
(n = 100 to 1000)
P-3
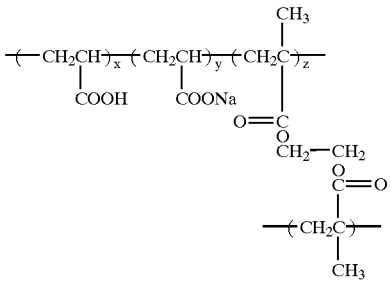
x:y:z = 42.5:7.5:50
P-4
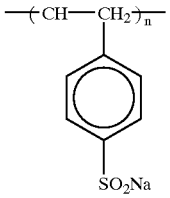
(n = 100~1000)
F-1
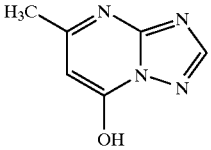
F-2
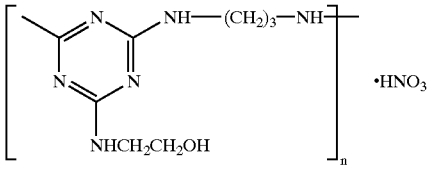
(n = 3~4)
F-3
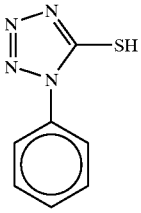
F-4
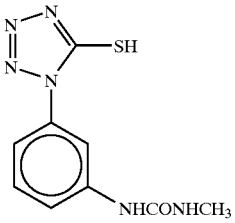
F-5
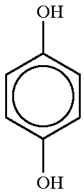
F-7
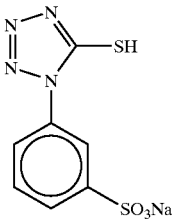
F-6
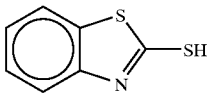
F-8
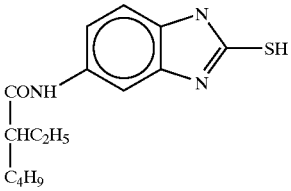
F-9
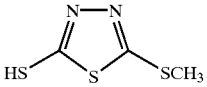

-continued

SO-1

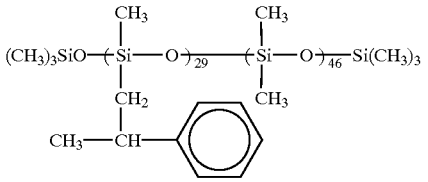

Preparation of Dispersions of Organic Solid Disperse Dyes (Preparation of Solid Dispersion of Dye E-1)

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 L/min for 2 hr. The beads were filtered out, and water was added to dilute the material to a dye concentration of 3%. After that, the material was heated to 90° C. for 10 hr for stabilization. The average grain size of the obtained fine dye grains was 0.30 $\mu$m, and the grain size distribution (grain size standard deviation×100/average grain size) was 20%.

(Preparation of Solid Dispersion of Dye E-2)

Water and 270 g of W-4 were added to 1,400 g of a wet cake of E-2 containing 30 mass % of water, and the resultant material was stirred to form a slurry having an E-2 concentration of 40 mass %. Next, the Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 L/min for 8 hr, thereby obtaining a solid fine-grain dispersion of E-2. This dispersion was diluted to 20 mass % by ion exchange water to obtain a solid fine-grain dispersion. The average grain size was 0.15 $\mu$m.

Then, the compound of general formula (I) or comparative compounds A and B shown below (the comparative compound A whose σp value does not satisfy the requirement of the present invention) were added to the sample 101 to prepare the samples 102 to 118. The addition amount is 15 mmol per 1 $m^2$ of the lightsensitive material, and the compound of general formula (I) and comparative compounds were emulsified and dispersed using a high-boiling organic solvent Oil-3 by 5-fold amount at a mass ratio (the amount of a high-boiling organic solvent is not also changed when the reductive compound represented by general formula (R-I) was added.). The added layer (emulsion face side) was shown at the same time. The compound was added to two spots of the first layer and the seventh layer in case of the sample 118.

TABLE 6

| Configuration of sample | | | | | |
|---|---|---|---|---|---|
| Sample No. | Remarks | Added layer | Compound of general formula (I) or comparative comound | Compound of general formula (R-I) | mol number of general formula (R-I)/mol number of general formula (I) |
| 101 | Comparative example | — | — | — | — |
| 102 | Comparative example | 2nd layer | 2-mercaptopropionic acid | — | — |
| 103 | Comparative example | 2nd layer | 2-N,N-dimethylethylmercaptane | — | — |
| 104 | Comparative example | 2nd layer | Comparative comound A | — | — |
| 105 | Comparative example | 2nd layer | Comparative comound A | (R-12) | 1.0 |
| 106 | Comparative example | 2nd layer | Comparative comound B | — | — |
| 107 | Comparative example | 2nd layer | Comparative comound B | (R-12) | 1.0 |
| 108 | Present invention | 2nd layer | (1) | — | — |
| 109 | Present invention | 2nd layer | (14) | — | — |
| 110 | Present invention | 2nd layer | (14) | (R-2) | 1.5 |
| 111 | Present invention | 1st layer | (1) | (R-3) | 1.5 |
| 112 | Present invention | 1st layer | (14) | (R-12) | 1.0 |
| 113 | Present invention | 3rd layer | (11) | (R-5) | 1.2 |
| 114 | Present invention | 3rd layer | (2) | (R-12) | 1.0 |
| 115 | Present invention | 7th layer | (2) | — | — |
| 116 | Present invention | 8th layer | (6) | — | — |
| 117 | Present invention | 12th layer | (10) | (R-5) | 1.0 |
| 118 | Present invention | 1st layer | (1) | (R-12) | 1.0 |
| | | 7th laer | (14) | (R-13) | 1.0 |

Relative Compounds

Relative compound A (Compound I-4 described in JP-A-1-26852)

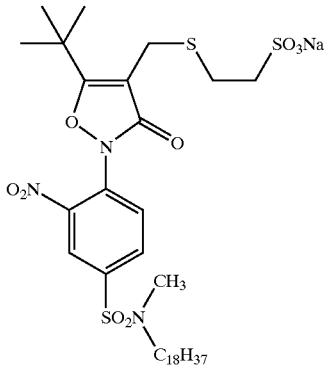

Relative Compound B (Compound I-27 described in JP-A-1-26852)

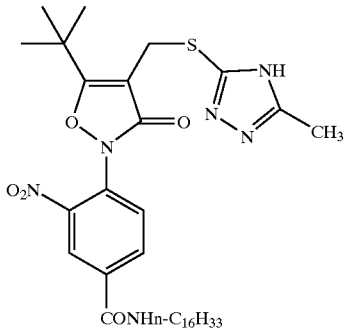

First, (development processing A) described below was carried out in the present Example.

Further, the processing was carried out in like manner as in the (development processing A) except that the amount of thioglycerol in the replenishing liquid of pre-bleaching was reduced by 0.02 g per 1L and the replenishing amount was reduced by 800 mL per 1 $m^2$ of a processing area, and it was referred to as (development processing B).

When the respective samples are processed, a half of the area ratio of the sample 101 was completely exposed, and the residual was unexposed, and the samples thus processed were used after passing until the replenishing amount becomes 5-fold of a tank capacity.

| Processing Step | Time | Temperature | Tank volume | Replenishment rate |
|---|---|---|---|---|
| 1st development | 6 min | 33° C. | 37 L | 1,100 mL/$m^2$ |
| 1st washing | 2 min | 38° C. | 16 L | 4,000 mL/$m^2$ |
| Reversal | 2 min | 38° C. | 17 L | 1,100 mL/$m^2$ |
| Color development | 6 min | 38° C. | 30 L | 1,100 mL/$m^2$ |
| Pre-bleaching | 2 min | 38° C. | 19 L | 1,100 mL/$m^2$ |
| Bleaching | 6 min | 38° C. | 30 L | 220 mL/$m^2$ |
| Fixing | 4 min | 38° C. | 29 L | 1,100 mL/$m^2$ |
| 2nd washing | 4 min | 38° C. | 35 L | 4,000 mL/$m^2$ |
| Final rinsing | 1 min | 25° C. | 19 L | 1,100 mL/$m^2$ |

The compositions of the processing solutions were as follows.

| <1st developer> | <Tank solution> | <Replenisher> |
|---|---|---|
| Nitrilo-N,N,N-trimethylene phosphonic acid · pentasodium salt | 1.5 g | 1.5 g |
| Diethylenetriamine pentaacetic acid · pentasodium salt | 2.0 g | 2.0 g |
| Sodium sulfite | 28 g | 30 g |
| Hydroquinone · potassium monosulfonate | 18 g | 20 g |
| Potassium carbonate | 20 g | 20 g |
| Potassium bicarbonate | 15 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 3.5 mg | — |
| Diethyleneglycol | 15 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid · pentasodium salt | 3.0 g | the same as tank solution |
| Stannous chloride · dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid · pentasodium salt | 2.0 g | 2.0 g |
| Sodium sulfite | 7.0 g | 7.0 g |
| Trisodium phosphate · dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfonamidoethyl)-3-methyl-4 aminoaniline · 3/2 sulfuric acid · monohydrate | 11 g | 11 g |
| 3,6-dithiaoctane-1,8-diol | 1.0 g | 1.0 g |
| Water to make | 1,000 mL | 1,000 mL |
| pH | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid · disodium salt · dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.3 | 6.10 |

The pH was adjusted by acetic acid or sodium hydroxide.

| <Bleaching solution> | <Tank solution> | <Replenisher> |
|---|---|---|
| Ethylenediaminetetraacetic acid · disodium salt · dihydrate | 2.0 g | 4.0 g |
| Ethylenediaminetetraacetic acid · Fe(III) · ammonium · dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |

-continued

| <Stabilizer> | <Tank solution> | <Replenisher> |
|---|---|---|
| Polymaleic acid (average molecular weight = 2,000) | 0.1 g | 0.15 g |
| Water to make | 1,000 mL | 1,000 mL |
| pH | 7.0 | 7.0 |

(Evaluation of Sample)

(Evaluation of Desilverization)

Each of the samples 101 to 118 was cut into a size of 10 cm×12.5 cm, it was mounted in a camera, and the photographing of landscape and a person was carried out by 10 scenes a with respect to each of the samples. Photographing was carried out at exposure by which the minimum concentration can be detected for the respective samples, in a sensitizing development in which the time of the first development was elongated to 11 minutes for all of the samples 101 to 118.

The processing of the photographed samples were similarly carried out except that the time of the first development was set to 11 minutes in the above-mentioned (development processing B), and the residual silver amount of the minimum concentration portion was measured according to fluorescent X-ray spectroscopy. The result in which the average value of the respective 10 scenes was represented as a ratio based on 1.0 of the residual silver amount of the sample 101 was shown in FIG. 7. The smaller the value is, the less the residual silver amount is preferably. Further, when the development processing A was carried out to the sample 101, the residual silver amount was 0.10 by the value. When the value is 0.2 or less, it was a level in which the residue of a metal silver is not observed by functional evaluation.

(Evaluation of Influence to Sensitivity)

After the samples 101 to 128 were cut in strips mode, they were exposed by white light of a color temperature of 4800 degrees through a wedge in which concentration is continuously varied, and processed by the (development processing A) while setting the time of the first development at 11 minutes. The concentration (status A) of a sample treated was measured, and exposure (log E) which applies a cyan concentration of 0.5 was determined. Exposure which applies a cyan concentration of 0.5 for the sample 101 is defined as (0), and a direction to which the sensitivity is enhanced was shown by a positive value and by the variation of logarithm of the exposure. The value is preferably close to 0.

TABLE 7

| Sample No. | Remarks | Result of evaluation: Residual silver amount of minimum concentration portion (ratio to sample 101) | Result of evaluation: Influence to sensitivity (Variation of exposure (in logarithm) which applies a cyan concentration of 0.5 with reference to that of sample 101) |
|---|---|---|---|
| 101 | Comparative example | 1.0 (basis) | 0 (basis) |
| 102 | Comparative example | 0.5 | −1.20 |
| 103 | Comparative example | 0.6 | −0.50 |
| 104 | Comparative example | 0.5 | −0.90 |
| 105 | Comparative example | 0.5 | −1.10 |

TABLE 7-continued

| Sample No. | Remarks | Result of evaluation: Residual silver amount of minimum concentration portion (ratio to sample 101) | Result of evaluation: Influence to sensitivity (Variation of exposure (in logarithm) which applies a cyan concentration of 0.5 with reference to that of sample 101) |
|---|---|---|---|
| 106 | Comparative example | 1.0 | −0.20 |
| 107 | Comparative example | 1.0 | −0.50 |
| 108 | Present invention | 0.3 | 0 |
| 109 | Present invention | 0.3 | 0 |
| 110 | Present invention | 0.15 | 0 |
| 111 | Present invention | 0.15 | 0 |
| 112 | Present invention | 0.1 | 0 |
| 113 | Present invention | 0.15 | 0 |
| 114 | Present invention | 0.15 | 0 |
| 115 | Present invention | 0.2 | 0 |
| 116 | Present invention | 0.3 | 0 |
| 117 | Present invention | 0.15 | 0 |
| 118 | Present invention | 0.1 | 0 |

As shown in FIG. 7, when 2-mercaptopropionic acid or 2-N,N-dimethylethylmercaptane is added, the lowering of the sensitivity was vigorous although the residual silver amount is reduced (samples 102 and 103). Further, the problem of the lowering of the sensitivity was not yet solved by using the comparative compounds A and B and by using the comparative compounds A and B and the reductive agent in combination (samples 104 to 107).

To the contrary, the variation of the sensitivity is completely suppressed in case of the samples 108 to 116 which used the compound of general formula (I) of the present invention. Further, it is succeeded that the residual silver amount is remarkably reduced while completely suppressing the variation of the sensitivity by using the reducing agent in combination (samples 110 to 114, 117 and 118). Although the present invention is the developed form of technique disclosed in JP-A-1-26852, it cannot be anticipated from the technical disclosure of JP-A-1-26852 that such ideal result including the sensitizing development is obtained by using the compound of general formula (I) of the present invention in combination with the reducing agent, therefore it is a marvelous result.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic light-sensitive material comprising at least one blue-sensitive emulsion layer, at least one green-sensitive emulsion layer, and at least one red-sensitive emulsion layer on a support, said material containing at least one kind of a compound represented by formula (I):

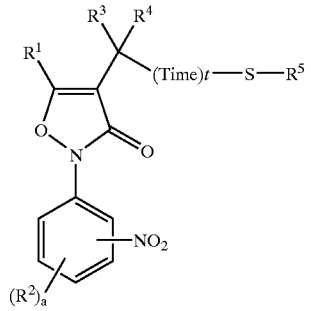

(I)

Where each of $R^1$, $R^3$ and $R^4$ independently represents a hydrogen atom or a substituent, $R^2$ represents a substituent, a represents an integer of 0 to 4, wherein if a is not less than 2, a plurality of $R^2$'s may be the same or different, and if a is 1, $R^2$ is selected from substituents having a σp value of 0 to 0.53, and if a is 2 to 4, $R^2$ is selected from substituents having a σp value of 0 to 0.53 in total, Time represents a group which releases —S—$R^5$ after being eliminated as $(Time)_t$-S—$R^5$, t is 0 or 1, and $R^5$ represents an organic group which is bonded with S by its $sp^3$ carbon, wherein a sulfur atom of —S—$R^5$ is bonded with a carbon which is directly substituted with $R^3$ and $R^4$, if t is 0.

2. The silver halide color photographic lightsensitive material according to claim 1, wherein at least one $R^2$ in formula (I ) represents an acyl group, an alkoxycarbonyl group, an aryloxycarbonyl group, an alkylaminocarbonyl group or an arylaminocarbonyl group.

3. The silver halide color photographic lightsensitive material according to claim 1, wherein the compound represented by formula (I) is represented by formula (II):

(II)

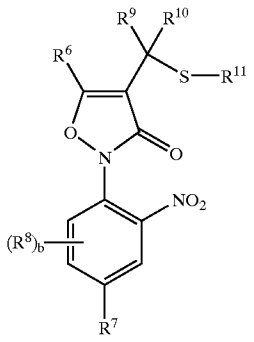

Where each of $R^6$, $R^9$ and $R^{10}$ independently represents a hydrogen atom or a substituent, $R^7$ represents a group selected from an acyl group, an alkoxycarbonyl group, an aryloxycarbonyl group, an alkylaminocarbonyl group, and an arylaminocarbonyl group, $R^8$ represents a substituent, b is an integer of 0 to 3, wherein if b is 2 or 3, a plurality of $R^8$'s may be the same or different, and the total of the σp value of $R^7$ and the σp value of $R^8$ is 0 to 0.53, and $R^{11}$ represents an organic group which is bonded with S by its $sp^3$ carbon.

4. The silver halide color photographic lightsensitive material according to claim 3, wherein b in formula (II) is 0.

5. A color image forming method wherein after image-wise exposure of the silver halide color photographic light-sensitive material according to claim 1, it is developed by the first development being black and white development, then subjected to reverse treatment, and color development is carried out in the presence of an aromatic primary amine color developer.

6. A color image forming method wherein after image-wise exposure of the silver halide color photographic light-sensitive material according to claim 2, it is developed by the first development being black and white development, then subjected to reverse treatment, and color development is carried out in the presence of an aromatic primary amine color developer.

7. A color image forming method wherein after image-wise exposure of the silver halide color photographic light-sensitive material according to claim 3, it is developed by the first development being black and white development, then subjected to reverse treatment, and color development is carried out in the presence of an aromatic primary amine color developer.

8. A color image forming method wherein after image-wise exposure of the silver halide color photographic light-sensitive material according to claim 4, it is developed by the first development being black and white development, then subjected to reverse treatment, and color development is carried out in the presence of an aromatic primary amine color developer.

* * * * *